US005354635A

United States Patent [19]

Itami et al.

[11] Patent Number: 5,354,635

[45] Date of Patent: Oct. 11, 1994

[54] ELECTROPHOTOGRAPHIC PHOTORECEPTOR COMPRISING MIXED CRYSTALS OF TITANYLPHTHALOCYANINE AND VANADYLPHTHALOCYANINE

[75] Inventors: Akihiko Itami, Hachioji; Kazumasa Watanabe, Fuchu, both of Japan

[73] Assignee: Konica Corporation, Tokyo, Japan

[21] Appl. No.: 92,581

[22] Filed: Jul. 16, 1993

Related U.S. Application Data

[63] Continuation of Ser. No. 831,568, Feb. 5, 1992, abandoned.

[30] Foreign Application Priority Data

Feb. 7, 1991 [JP] Japan ..... 3-016581

[51] Int. Cl.[5] ..... G03G 5/06

[52] U.S. Cl. ..... 430/58; 430/56; 430/78

[58] Field of Search ..... 430/58, 56, 59, 78

[56] References Cited

U.S. PATENT DOCUMENTS 4,981,767 1/1991 Tokura et al. ..... 430/58
5,153,313 10/1992 Kazmaier et al. ..... 540/138

FOREIGN PATENT DOCUMENTS 0348889 3/1990 European Pat. Off. .
2070763 3/1990 Japan .
1152655 5/1969 United Kingdom .

OTHER PUBLICATIONS

English Translation of JP 2-70763 to T. Iwabuchi et al.

*Primary Examiner*—Marion E. McCamish
*Assistant Examiner*—Rosemary Ashton
*Attorney, Agent, or Firm*—Finnegan, Henderson, Farabow, Garrett & Dunner

[57] ABSTRACT

An electrophotographic photoreceptor having a charge generation material is disclosed. The charge genaration material is mixed crystals of a titanylphthalocyanine and a vanadyl phtalocyanine, which have a characteristic peak at a Bragg angle ($2\theta$) of $27.2\pm0.2°$ in an X-ray diffraction spectrum with a Cu-K $\alpha$ ray (wave length: 1.541 Å) and having other specific physical property. The photoreceptor is suitably used in a printer or photocopying machine.

10 Claims, 14 Drawing Sheets

ELECTROPHOTOGRAPHIC PHOTORECEPTOR COMPRISING MIXED CRYSTALS OF TITANYLPHTHALOCYANINE AND VANADYLPHTHALOCYANINE

This application is a continuation, of application Ser. No. 07/831,568, filed Feb. 5, 1992, now abandoned.

BACKGROUND OF THE INVENTION

The present invention relates to an electrophotographic photoreceptor, more specifically to an electrophotographic photoreceptor using a photoconductive material comprised of mixed crystals of a titanylphthalocyanine and a vanadylphthalocyanine, useful for the use of printers and copying machines, and suitable for the image formation by use of semi-conductor laser beams or LED beams as an exposing means.

In recent years, photoconductive materials are intensively studied and used as a photoelectric transfer element in electrophotographic photoreceptors, solar batteries and image sensors. As such photoconductive materials, inorganic materials have been widely used so far. In electrophotographic photoreceptors, for example, there have been mostly used inorganic photoreceptors having a photoreceptive layer whose primary component is an inorganic photoconductive material such as selenium, zinc oxide or cadmium sulfide.

However, such inorganic photoreceptors are not necessarily satisfactory in the properties of photosensitivity, heat stability, moisture resistance and durability, which are required of electrophotographic photoreceptors for copying machines and printers. Selenium, for example, is liable to crystallize with heat or stains such as fingerprints and thereby deteriorates in properties required of electrophotographic photoreceptors. An electrophotographic photoreceptor using cadmium sulfide is poor in moisture resistance and durability, and that using zinc oxide has a problem in durability.

Further, in the growing importance of improving environmental sanitation, electrophotographic photoreceptors comprised of selenium or cadmium sulfide have a disadvantage of requiring a rigid control in manufacturing and handling because of their toxicity.

In order to eliminate these shortcomings of inorganic photoconductive materials, organic photoconductive materials have come to be actively studied, and various attempts have been made concerning the use of them in a photoreceptive layer of electrophotographic photoreceptor. Japanese Pat. Exam. Pub. No. 10496/1975 discloses an organic photoreceptor having a photoreceptive layer containing poly-N-vinylcarbazole and trinitrofluorenone, but this photoreceptor is not adequate in sensitivity and durability. For the purpose of solving these problems, a function-separating electrophotographic photoreceptor has been developed, in which a carrier generation function and a carrier transfer function are separately provided by different materials.

Such function-separating photoreceptors have an advantage that materials having desired characteristics can be selected from a wide range of compounds to prepare with ease photoreceptors of high sensitivity and excellent durability.

Various organic compounds have been proposed as a carrier generation material or a carrier transfer material for electrophotographic photoreceptors. As the carrier generation material which controls the basic characteristics of a photoreceptor, there have come to be practically used photoconductive materials such as polycyclic quinones represented by dibromoanthanthrone, pyrylium compounds and their eutectic complexes, squarium compounds, phthalocyanine compounds and azo compounds.

However, carrier generation materials having a much higher carrier generation efficiency are required to improve the sensitivity of organic photoreceptors much more. From this viewpoint, phthalocyanine compounds have come to draw much attention for their high photoconductivity, and active studied are being made in connection with their application.

It is known that phthalocyanines vary in physical properties such as absorption spectrum and photoconductivity according to their crystal forms and the kind of the central metal. For example, M. Sawata reports, in Senryo To Yakuhin, 24 (6), 122 (1979), that copper phthalocyanine has four crystal forms of type-, -$\alpha$, -$\beta$, -$\gamma$ and -$\epsilon$ which are greatly different in electrophotographic properties.

In addition, four primary crystal forms of type-A, -B, -C and -Y are also reported for titanylphthalocyanines which attract much attention in recent years. However, any of type-A titanylphthalocyanine disclosed in Japanese Pat. O.P.I. Pub. No. 67094/1987, type-B disclosed in Japanese Pat. O.P.I. Pub. No. 239248/1986 and type-C disclosed in Japanese Pat . O.P.I. Pub. No. 256865/1987 is not necessarily satisfactory in electrification property and electrophotographic sensitivity. Titanylphthalocyanine reported recently by Oda et al. in Electrophotography, 29 (3), 250 (1990) has a high sensitivity, but it is not satisfactory in electrification property; therefore, development of a carrier generation material high in both electrification property and sensitivity is demanded.

Vanadylphthalocyanines also appear in research reports and patents frequently. Japanese Pat. O.P.I. Pub. No. 217074/1989 discloses a photoreceptor containing a vanadylphthalocyanine of which crystal form is corresponding to the crystal form of type-B titanylphthalocyanine, and Japanese Pat. O.P.I. Pub. No. 204968/1989 discloses one comprised of vanadylphthalocyanine having a crystal form corresponding to that of type-A, but these crystal forms cannot provide an adequate sensitivity. In addition, Japanese Pat. O.P.I. Pub. No. 268763/1989 discloses use of the crystal form which has a characteristic peak at a Bragg angle ($2\theta$) of 27.2°, like the crystal form of titanylphthalocyanine shown as a comparative example in Japanese Pat. O.P.I. Pub. No. 67094/1987. But its sensitivity is not adequate, either. The reason of this lies in the fact that the crystal forms of both the vanadylphthalocyanine and the titanylphthalocyanine having a characteristic peak only at a Bragg angle ($2\theta$) of 27.2° are distinctly different in three-dimensional crystal configuration from the crystal form of high sensitive type-Y titanylphthalocyanine, which has another characteristic peak at 9.5°. As described above, there has not been reported so far a crystal form of vanadylphthalocyanine which can provide a high sensitivity.

Recently, mixed crystals of phthalocyanines are reported, in which a specific crystal configuration is formed by use of plural phthalocyanines. These mixed crystals are greatly different from a mere mixture of plural phthalocyanines and have an advantage of providing properties different from those of a single phthalocyanine or a mixture thereof. In connection with such mixed crystals, Japanese Pat. O.P.I. Pub. No.

84661/1990 discloses the formation of mixed crystals on a substrate by co-deposition of two or more phthalocyanines from a gas phase. But the crystal form of mixed crystals between a copper phthalocyanine and a nonmetal phthalocyanine, as well as that of mixed crystals between a titanylphthalocyanine and a nonmetal phthalocyanine, each described therein have problems in sensitivity. Japanese Pat. O.P.I. Pub. No. 70763/1990 discloses two types of mixed crystals prepared by vapor deposition of a titanylphthalocyanine and a vanadylphthalocyanine, which correspond to type-A and type-B titanylphthalocyanines, respectively, but their sensitivities are unsatisfactory. As described above, it is important to select properly the crystal form of mixed crystals and the types of phthalocyanines used to form mixed crystals, otherwise mixed crystals of desired properties cannot be obtained. From this point of view, not only the selection of the materials but also a crystal-controlling technique to obtain a specific crystal form are important; therefore, development of a crystal conversion technique is demanded, in addition to the conventional vapor deposition method to form mixed crystals.

SUMMARY OF THE INVENTION

The object of the present invention is to provide an electrophotographic photoreceptor which has a good electrification property and a high sensitivity and is weaned from the shortcomings described above.

It is widely known that characteristics of an electrophotographic photoreceptor substantially vary with the kind of the central metal and the crystal form of a phthalocyanine used. Therefore, it is important to use a phthalocyanine having a stable crystal form capable of providing a good electrification property and a high sensitivity. The titanylphthalocyanine having a characteristic peak at a Bragg angle ($2\theta$) of $27.2\pm0.2°$ is well known to have a very high sensitivity among the conventional photoconductive materials, but its electrification property is not adequate for the use of electrophotographic photoreceptors. Therefore, a charge generation material having an excellent electrification property and a high sensitivity is searched for, in order to provide photoreceptors with satisfactory properties. The photoreceptor of the invention comprises a support and a photoreceptor. The photoreceptive layer comprises one of the mixed crystals of a titanylphthalocyanine and a vanadylphthalocyanine having a characteristic peak at a Bragg angle ($2\theta$) of $27.2\pm0.2°$ in an X-ray spectrum with a Cu-K$\alpha$ ray (wavelength: 1.541 Å) and having an exothermic peak between 150° C. and 400° C. in differential thermal analysis, or the mixed crystals of a titanylphthalocyanine and a vanadylphthalocyanine having characteristic peaks at Bragg angles ($2\theta$) of $9.5\pm0.2°$ and $27.2\pm0.2°$, and the mixed crystals of a titanylphthalocyanine and a vanadylphthalocyanine having characteristic peaks at Bragg angles ($2\theta$) of $9.1\pm0.2°$ and $27.2\pm0.2°$.

DETAILED DISCLOSURE OF THE INVENTION

Figure 1:
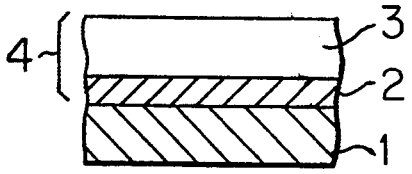
FIGS. 1 to 6 are sectional views showing examples of the layer structure of the respective photoreceptors according to the invention.
Figure 2:
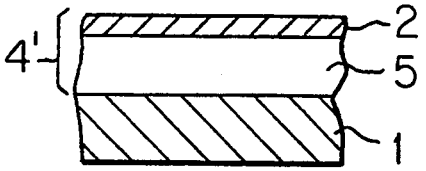

The term "mixed crystals" means a crystal which contains two or more kinds of substances that are mixed uniformly before or during crystallization, and it is known that the mixed crystals are formed between salts having the same crystal form as seen in alum, or metals having analogous crystal lattices or atomic radius similar to each other. Analogous facts are also observed in the phthalocyanine mixed crystals having the crystal form of the invention, and compounds similar to titanylphthalocyanine in structure have a tendency to form mixed crystals together with titanylphthalocyanine. In the crystal structure of titanylphthalocyanine made clear by W. Hiller et al. in Z. Kristallogr., 159, 173(1982), the Ti=O bond projects upward with respect to the conjugated plane of phthalocyanine ring. Accordingly, this titanylphthalocyanine can hardly form mixed crystals of high crystal purity required in the invention, in conjunction with nonmetal phthalocyanine which has a plane structure. As a result, the crystal form of the invention is infected with other crystal forms to cause deterioration in properties. According to the crystal structure of vanadylphthalocyanine elucidated by R. Ziolo et al. in J. Chem. Soc. Dalton, 2300 (1980), the three-dimensional structure of this compound well resembles that of tinanylphthalocyanine, except a slight difference between Ti=O bond and V=O bond. Therefore, it is thought that mixed crystals tend to be formed between vanadylphthalocyanine and titanylphthalocyanine. Actually, the crystal form of the invention was obtained by use of these two compounds, but no prescribed crystal form was obtained when the vanadylphthalocyanine was combined with other phthalocyanines.

The titanylphthalocyanine used in the invention is represented by the following formula I, and the vanadylphthalocyanine is represented by the following formula II.

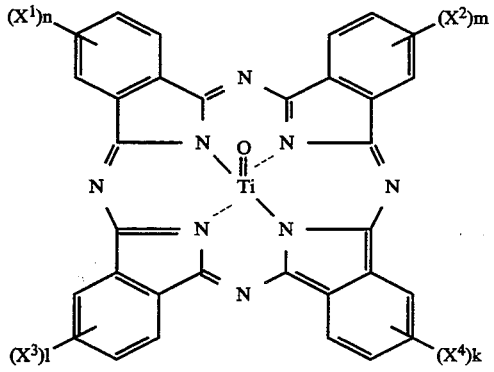

I

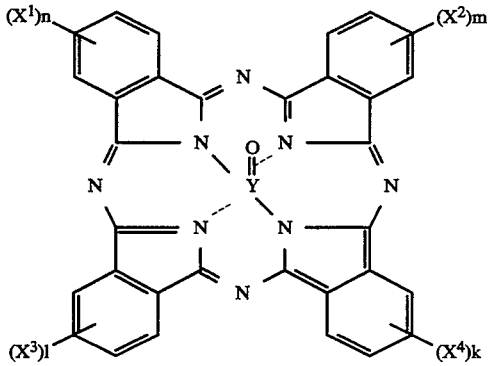

II

In Formulas I and II, $X^1$, $X^2$, $X^3$ and $X^4$ each represent a hydrogen or halogen atom, or an alkyl, alkoxy or aryloxy group; and k, l, m and n each represent an integer of 0 to 4.

In the invention, the X-ray diffraction spectrum was measured under the following conditions, where "characteristic peak" is a clear projection of an acute angle which differs from noise.

| | |
|---|---|
| X-ray vessel | Cu |
| Voltage | 40.0 Kv |
| Current | 100 mA |
| Start angle | 6.0 deg. |
| Stop angle | 35.0 deg. |
| Step angle | 0.02 deg. |
| Measuring time | 0.50 sec. |

Differential thermal analysis was carried out using 10 to 50 mg of a sample in every measurement and at a temperature raising speed of 30 (°K./min). As a sample, a powder of a titanylphthalocyanine-vanadylphthalocyanine mixed crystals prepared in the crystal form of the invention was used. Measurement was also made in the same manner using the titanylphthalocyanine-vanadylphthalocyanine mixed crystals peeled off from a photoreceptor which was made of the above powdered; the results were the same as those with the powdered mixed crystals.

The exothermic peak appears between 150° C. and 400° C. in differential thermal analysis is inherent in the crystal form of phthalocyanine according to the invention among the various crystal forms which phthalocyanines may have, therefore, observation of only this exothermic peak is enough to judge whether or not a crystal is the titanylphthalocyanine-vanadylphthalocyanine mixed crystals of the invention.

The exothermic peak in differential thermal analysis is a clear peak on a thermogram, and the exothermic peak temperature is a temperature corresponding to the maximum value of the peak.

This exothermic peak observed for the titanylphthalocyanine-vanadylphthalocyanine mixed crystals having the crystal form of the invention indicates a crystal transition point, at which temperature the crystal form of the invention transforms into a thermally stable crystal form. Accordingly, this value is an index to the thermal stability of phthalocyanine and closely relates to the arrangement of the crystal; that is, crystals different in crystal transition point are different in thermal behavior. For example, the crystal transition point of the titanylphthalocyanine-vanadylphthalocyanine mixed crystals of the invention varies with the component ratio of titanylphthalocyanine to vanadylphthalocyanine as shown later in Examples, and when a mixture of plural kinds of mixed crystals different in component ratio is subjected to differential thermal analysis, the crystal transition points of respective mixed crystals can be independently observed. When a titanylphthalocyanine having the crystal form of the invention is mixed with any crystal form of vanadylphthalocyanines, only the crystal transition point of the titanylphthalocyanine is observed. This differs from the case with the titanylphthalocyanine-vanadylphthalocyanine mixed crystals, because such a mere mixture as is used above is substantially different from the mixed crystals in which titanylphthlocyanine and vanadylphtalocyanine form a uniform solid solution.

The infrared absorption spectrum was measured under the following conditions.

Apparatus: FT-IR Model 60SX made by NICOLET(FT-IR 60SX).

Resolution: 0.25 $cm^{-1}$

Measuring method: Diffuse reflection, KBr powder

The titanylphthalocyanine used in the invention may be synthesized by various methods and can be typically synthesized according to the following reaction formula (1) or (2).

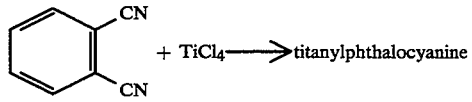

(1)

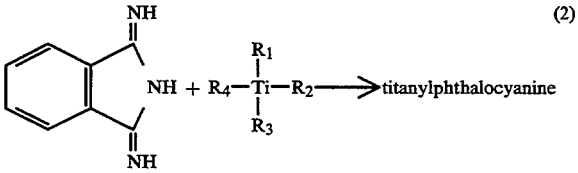

(2)

In the formulas, $R_1$ to $R_4$ each represent a group capable of splitting off.

The vanadylphthalocyanine used in the invention can be prepared, like the titanylphthalocyanine, by allowing o-phthalonitrile or 1,3-diiminoisoindoline to react with a vanadium reagent, such as vanadium pentaoxide or acetylacetone vanadium, in an inactive solvent such as 1-chloronaphthalene.

As the method to form mixed crystals from the titanylphthalocyanine and vanadylphthalocyanine prepared as above, there has so far been known only co-vapor deposition. As a result of the study made by the present inventors, however, it is found that the mixed crystals can also be prepared by other methods, including one comprising the steps of dissolving uniformly the two components in a solvent and allowing them to deposit, and one comprising the steps of mixing the two components in a solid state and giving them sear force in a manner such as milling.

To be concrete, usable methods for preparing mixed crystals other than co-vapor deposition include recrystallization, reprecipitation, acid past treatment, and dry or wet milling. With the establishment of these mixed crystals forming methods, the crystal form according to the invention has come to be formed stably. But usable methods for forming mixed crystals are not limited to them.

The method for preparing the titanylphthalocyanine-vanadylphthalocyanine mixed crystals having the crystal form of the invention is described below. First, titanylphthalocyanine-vanadylphthalocyaninne amorphous crystals were prepared by a method which comprises the steps of dissolving a titanylphthalocyanine and a vanadylphthalocyanine each having an arbitrary crystal form in a concentrated sulfuric acid using a usual acid paste treatment, pouring the sulfuric acid solution into water, and filtering precipitated crystals, or a method which comprises the steps of mixing a titanylphthalocyanine and a vanadylphthalocyanine each having an arbitrary crystal form, and grinding the mixture with mechanical force such as milling. In preparing the amorphous crystals, the acid paste treatment may be carried out under usual conditions. The amount of sulfuric acid is not particularly limited, but preferably 5 to 200 times the weight of a phthalocyanine. The amount of water, into which the sulfuric acid solution is poured, is preferably 5 to 100 times the weight of the sulfuric acid. The temperature at which the phthalocyanine is dissolved in the sulfuric acid is not more than 5° C., the temperature of the water at which the sulfuric acid solution is poured into is usually 0° to 50° C.

Next, the crystal form used in the invention is formed by treating the amorphous crystals with a specific organic solvent. Usable solvents are aliphatic hydrocarbons, aromatic hydrocarbons, halogenated hydrocarbons, alcohols, esters, ethers, organic acids, organic amines and heterocyclic compounds, and acids such as sulfonic acid or trichloroacetic acid may be added if necessary. The amorphous crystals may be subjected to the solvent treatment as either a wet paste containing water or a dry solid, and a suitable form can be selected according to the type of the organic solvent. Further, in the course of the solvent treatment, heating or milling may be made concurrently if necessary. As described in Synthesis example 6, crystals once converted into the crystal from of the invention in the above manner may be subjected again to the solvent treatment according to a specific requirement. However, methods for converting the crystal form are not necessarily limited to these ones.

The component ratio of titanylphthalocyanine to vanadylphthalocyanine in the titanylphthalocyanine-vanadylphthalocyanine mixed crystals of the invention is not particularly limited as long as both the phthalocyanines are present, but the content of titanylphthalocyanine is usually not less than 50%, preferably not less than 80%, and especially not less than 90%. The content used here is given in weight %.

The electrophtographic photoreceptor of the invention may use other photoconductive materials in conjunction with the titanylphthalocyanine-vanadylphthalocyanine mixed crystals. Examples of such jointly usable photoconductive materials include titanylphthalocyanines or vanadylphthalocyanines, of types -A, -B, -C and amorphous and such having a characteristic peak at a Bragg angle ($2\theta$) of 27.2° as type Y, metal free phthalocyanines of respective crystal forms, metal phthalocyanines represented by copper phthalocyanine, naphthalocyanines, porphyrin derivatives, azo compounds, polycyclic quinones represented by dibromoanthanthrone, pyrylium compounds and their eutectic complexes, and squarium compounds.

In the electrophtographic photoreceptor of the invention, a carrier transfer material may be jointly used. A variety of compounds can be used as a carrier transfer material, and representative ones include compounds having a nitrogen-containing heterocyclic nucleus or its condensed cyclic nucleus, which are represented by oxazole, oxadiazole, thiazole, thiadiazole and imidazole; polyarylalkane compounds, pyrazoline compounds, hydrazone compounds, triarylamine compounds, styryl compounds, poly(bis)styryl compounds, styryltriphenylamine compounds, β-phenylstyryltriphenylamine compounds, butadiene compounds, hexanetriene compounds, carbazole compounds and condensed polycyclic compounds. Typical examples of the carrier transfer material include, for example, ones described in Japanese Pat. O.P.I. Pub. No. 107356/1986. Chemical structures of the representative carrier transfer materials are shown below.

(1)

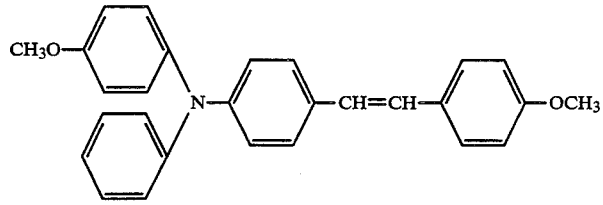

(2)

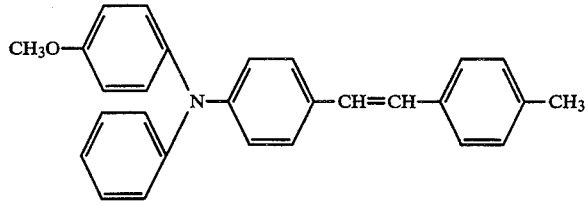

-continued
(3)
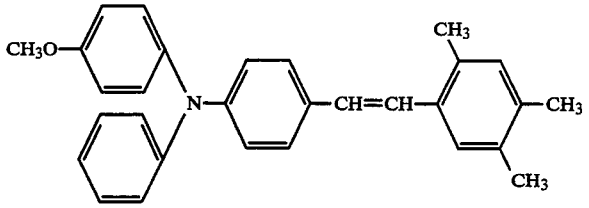
(4)
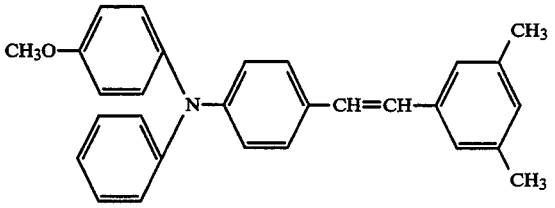
(5)
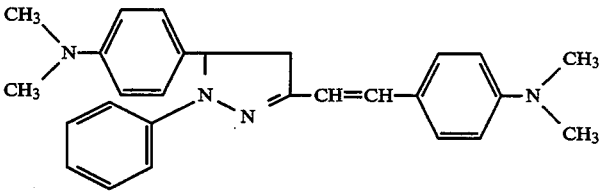
(6)
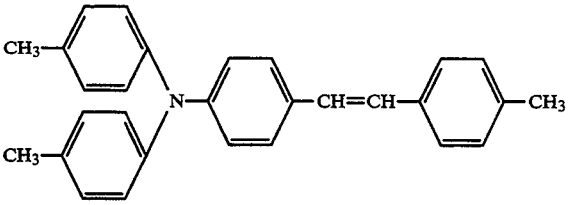
(7)
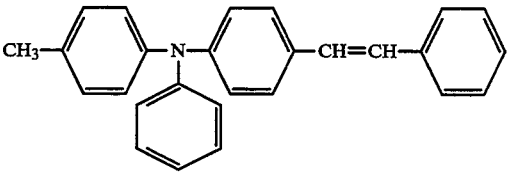
(8)
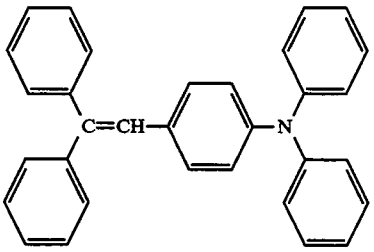
(9)
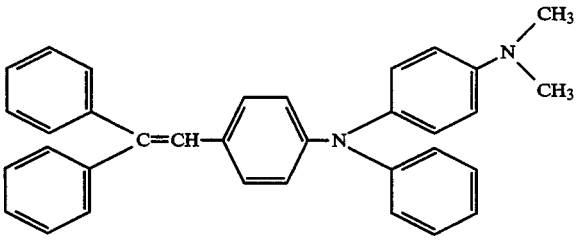

-continued
(10)
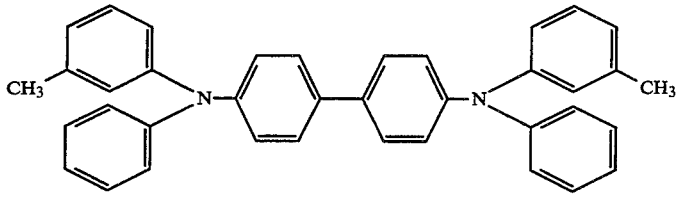
(11)
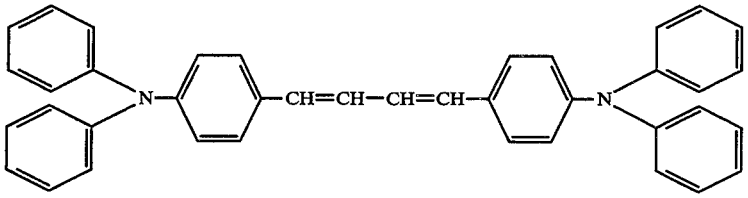
(12)
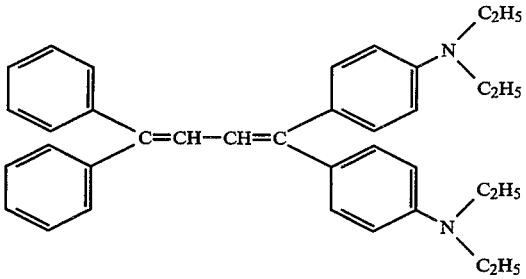
(13)
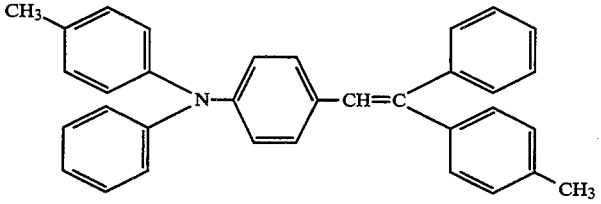
(14)
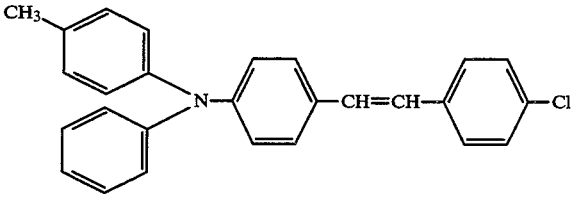
(15)
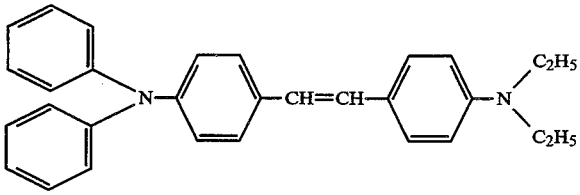
(16)
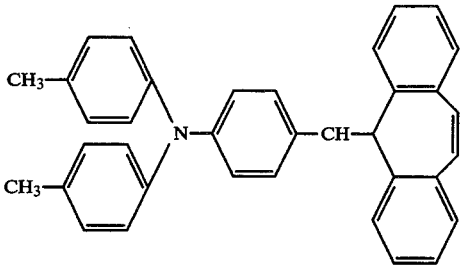

-continued (17)

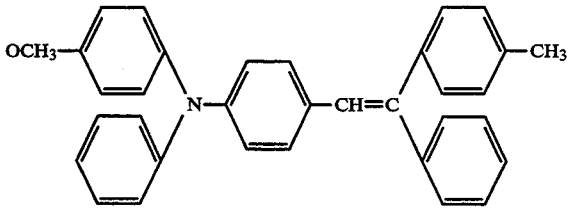

Figure 3:
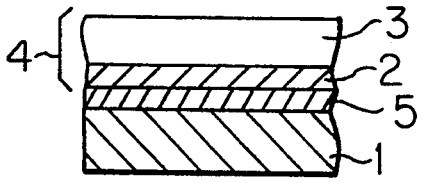
Figure 4:
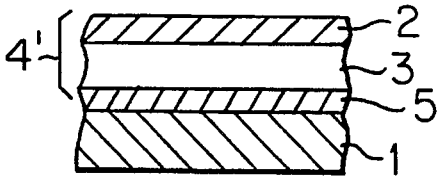
Figure 5:
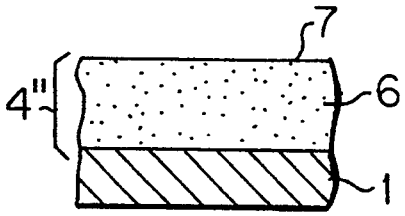
Figure 6:
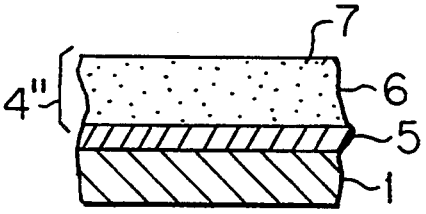

Various structures are known for photoreceptors, and the photoreceptor of the invention may use any of such structures. But preferable embodiments of the invention are those function-separating photoreceptors of laminated type or dispersing type which are illustrated in FIGS. 1 to 6. In the structure shown in FIG. 1, carrier generation layer 2 is formed on conductive support 1, and carrier transfer layer 3 is laminated thereon to form photoreceptive layer 4; in FIG. 2, photoreceptive layer 4' is formed with reverse order of carrier generation layer 2 and carrier transfer layer 3; FIG. 3 shows a structure in which intermediate layer 5 is provided between conductive layer 1 and photoreceptive layer 4 having the same layer configuration as that in FIG. 1; in FIG. 4, photoreceptive layer 4" containing carrier generation material 6 and carrier transfer material 7 is formed; and FIG. 6 shows a structure in which intermediate layer 1 is formed between conductive support 1 and photoreceptive layer 4" having the same layer structure as that shown in FIG. 5. In any of the structures illustrated in FIGS. 1 to 6, a protective layer may be provided as the uppermost layer.

A useful method to form such photoreceptive layers is to coat on a support a solution which dissolves singly a carrier generation material or a carrier transfer material or in combination with a binder and other additives. And in preparing such a coating solution, it is effective to disperse a carrier generation material, which is less soluble in solvents, to fine particles in a suitable dispersion medium by use of a dispersing means such as supersonic disperser, ball mill, sand mill or homo-mixer. In this case, a binder and additives are generally added to the dispersion.

The solvent or dispersion medium usable in preparing a coating solution to form a photoreceptive layer may be arbitrarily selected from conventional ones such as butylamine, ethylenediamine, N,N-dimethylformamide, acetone, methyl ethyl ketone, methyl isopropyl ketone, methyl isobutyl ketone, cyclohexanone, 4-methoxy-4-methyl-2-pentanone, tetrahydrofuran, dioxane, ethyl acetate, butyl acetate, t-butyl acetate, methyl cellosolve, ethyl cellosolve, butyl cellosolve, ethylene glycol dimethyl ether, toluene, xylene, acetophenone, chloroform, dichloromethane, dichloroethane, trichloroethane, methanol, ethanol, propanol and butanol.

When a binder is used to form a carrier generation layer or a carrier transfer layer, it may arbitrarily selected. But use of a hydrophobic polymer having a film forming property is preferred. Examples of such a polymer are shown below but not limited to them.

| | |
|---|---|
| Polycarbonate | Polycarbonate Z resin |
| Acrylic resin | Methacrylic resin |
| Polyvinyl chloride | Polyvinylidene chloride |
| Polystyrene | Styrene-butadiene copolymer |
| Polyvinyl acetate | Polyvinyl formal |
| Polyvinyl butyral | Polyvinyl acetal |
| Poly-N-vinylcarbazole | Styrene-alkyd resin |

-continued

| | |
|---|---|
| Silicone resin | Silicone-alkyd resin |
| Silicone-butyral resin | Polyester |
| Polyurethane | Polyamide |
| Epoxy resin | Phenolic resin |
| Vinylidene chloride-acrylonitrile copolymer | |
| Vinyl chloride-vinyl acetate copolymer | |
| Vinyl chloride-vinyl acetate-maleic anhydride copolymer | |

The ratio of carrier generation material to binder is preferably 10 to 600 wt %, especially 50 to 400 wt %. The ratio of carrier transfer material to binder is preferably 10 to 500 wt %. The thickness of a carrier generation layer is 0.01 to 20 μm, preferably 0.05 to 5 μm. The thickness of a carrier transfer layer is 1 to 100 μm, preferably 5 to 30 μm.

An electron accepting material may be used in the photoreceptive layer, for the purpose of improving sensitivity, decreasing residual voltage or lessening fatigue in repeating use. Examples of such an electron accepting material include succinic anhydride, maleic anhydride, dibromosuccinic anhydride, phthalic anhydride, tetrachlorophthalic anhydride, tetrabromophthalic anhydride, 3-nitrophthalic anhydride, 4-nitophthalic anhydride, pyromellitic anhydride, mellitic anhydride, tetracyanoethylene, tetracyanoquinodimethane, o-dinitrobenzene, m-dinitrobenzene, 1,3,5-trinitrobenzene, p-nitrobenzonitrile, picryl chloride, quinonechloroimide, chloranil, bromanil, dichlorodicyano-p-benzoquinone, anthraquinone, dinitroanthraquinone, 9-fluorenylidene malononitrile, polynitro-9-fluorenylidene malononitrile, picric acid, o-nitrobenzoic acid, p-nitrobenzoic acid, 3,5-dinitrobenzoic acid, pentafluorobenzoic acid, 5-nitrosalicylic acid, 3,5-dinitrosalicylic acid, phthalic acid, mellitic acid, and other compounds with a large electron affinity. The addition amount of the electron accepting material is 0.01 to 200 parts, preferably 0.1 to 100 parts, per 100 parts by weight of carrier generation material.

In addition, the photoreceptive layer may contain a deterioration inhibitor such as anti-oxidant and light stabilizer, in order to improve preservability, durability and environmental dependency. Compounds usable for these purposes are chromanol derivatives such as tocopherol and their ethers and esters, polyarylalkane compounds, hydroquinone compounds and their mono or diethers, benzophenone derivatives, benzotriazole derivatives, thioethers, phosphonates, phosphites, phenylenediamine derivatives, phenol compounds, hindered phenol compounds, straight-chain amines, cyclic amines and hindered amine compounds. Typical examples of preferred compounds include hindered phenol compounds such as IRGANOX 1010 and IRGANOX 565 made by Ciba Geigy, Sumilizer BHT and Sumulizer MDP made by Sumitomo Chemical; and hindered amine compounds such as Sanol LS-2626 and Sanol LS-622LD made by Sankyo.

As the binder for an intermediate layer or protective layer, there may be used ones exemplified above as binders for the carrier generation layer and carrier transfer layer. Other usable materials for this purpose include nylon resin; ethylene type resin such as ethylene-vinyl acetate copolymer, ethylene-vinyl acetate-maleic anhydride copolymer; polyvinyl alcohol and cellulose derivatives. Curable binders, which utilize the heat or chemical curing properties of melamine, epoxides and isocyanates, may also be used.

As the conductive support, metal plates and metal drums are used. There may also be used ones formed by providing a thin layer of a conductive polymer, conductive compound such as indium oxide, or metal such as aluminum or palladium, by means of coating, evaporation or lamination, on a paper or plastic substrate.

EXAMPLES

Synthesis of Titanylphthalocyanine

A mixture of 29.2 g of 1,3-diiminoisoindoline, 200 ml of o-dichlorobenzene and 20.4 g of titanium tetrabutoxide was refluxed for 3 hours under a nitrogen stream. After cooling the reaction mixture to room temperature, crystals deposited were filtered out and washed with o-dichlorobenzene, followed by washing with methanol. Further, the crystals were washed several times with a 2% aqueous solution of hydrochloric acid with stirring at room temperature, and then washed with deionized water repeatedly, followed by washing with methanol. Drying of the crystals gave 24.2 g of titanylphthalocyanine crystals in royal purple.

Synthesis of Vanadylphthalocyanine

A mixture of 29.2 g of 1,3-diiminoisoindoline, 200 ml of o-dichlorobenzene and8 g of vanadylacetyl acetate was refluxed for 5 hours under a nitrogen stream. After cooling the reaction mixture to room temperature, crystals deposited were filtered out and washed with o-dichlorobenzene, followed by washing with methanol. Further, the crystals were washed several times with a 2% aqueous solution of hydrochloric acid with stirring at room temperature, and then washed with deionized water repeatedly, followed by drying. Recrystallization of the crystals from 1-chloronaphthalene gave 18.9 g of violet vanadylphthalocyanine crystals.

Synthesis of Mixed Crystals

Synthesis Example 1

There were dissolved 4 g of titanylphthalocyanine and 1 g of vanadylphthalocyanine in 250 g of 96% sulfuric acid, while cooling them in an ice bath. The solution was poured into 5 liters of water, and an amorphous deposit formed in paste state was filtered out.

Figure 7:
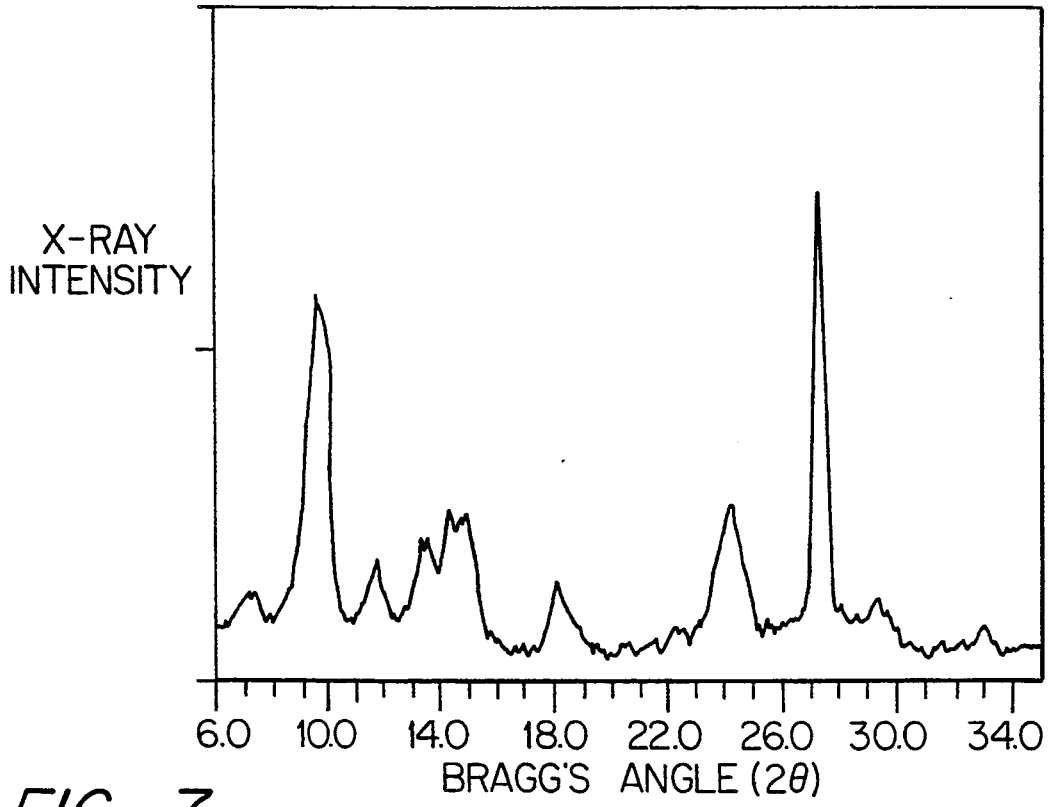
FIGS. 7 to 14 are X-ray diffraction spectra of the titanylphthalocyanine-vanadylphthalocyanine mixed crystals of the invention respectively prepared in Synthesis examples 1 to 8.
Figure 22:
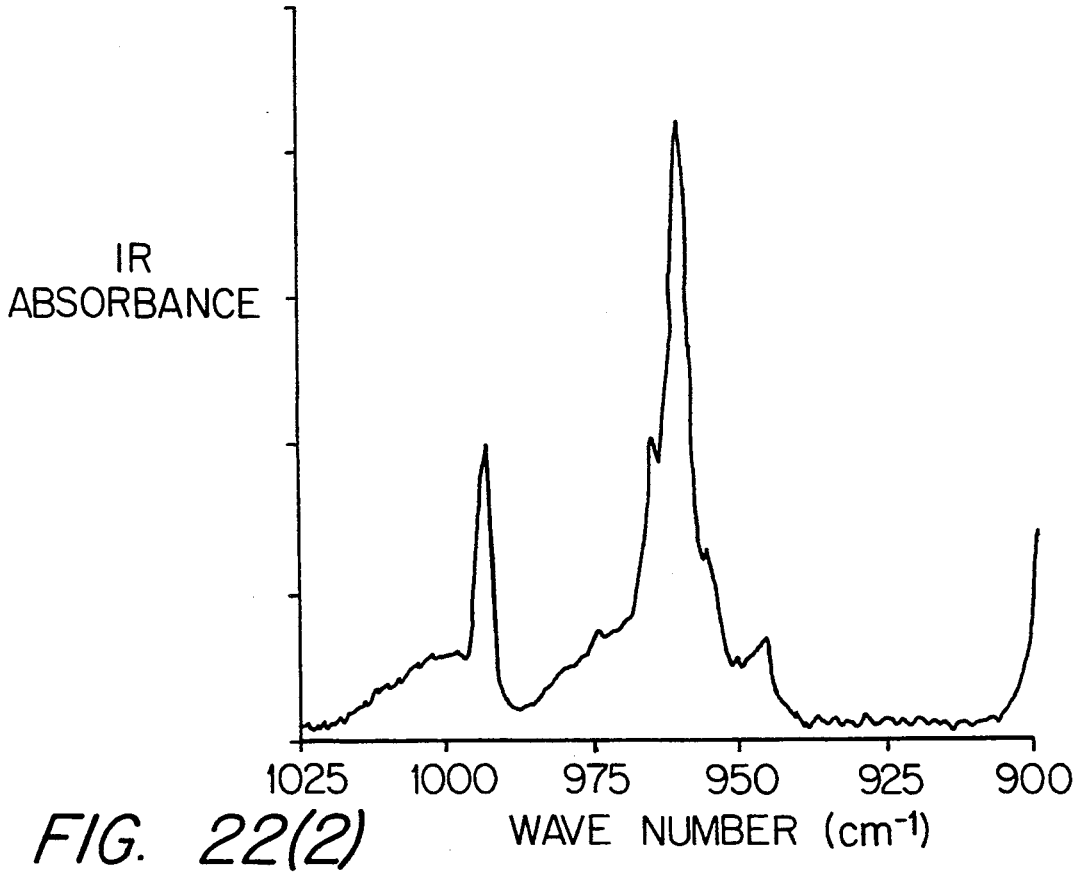
FIGS. 22 to 25 are infrared absorption spectra of the titanylphthalocyanine-vanadylphthalocyanine mixed crystals respectively prepared in Synthesis examples 1 to 4.
Figure 22:
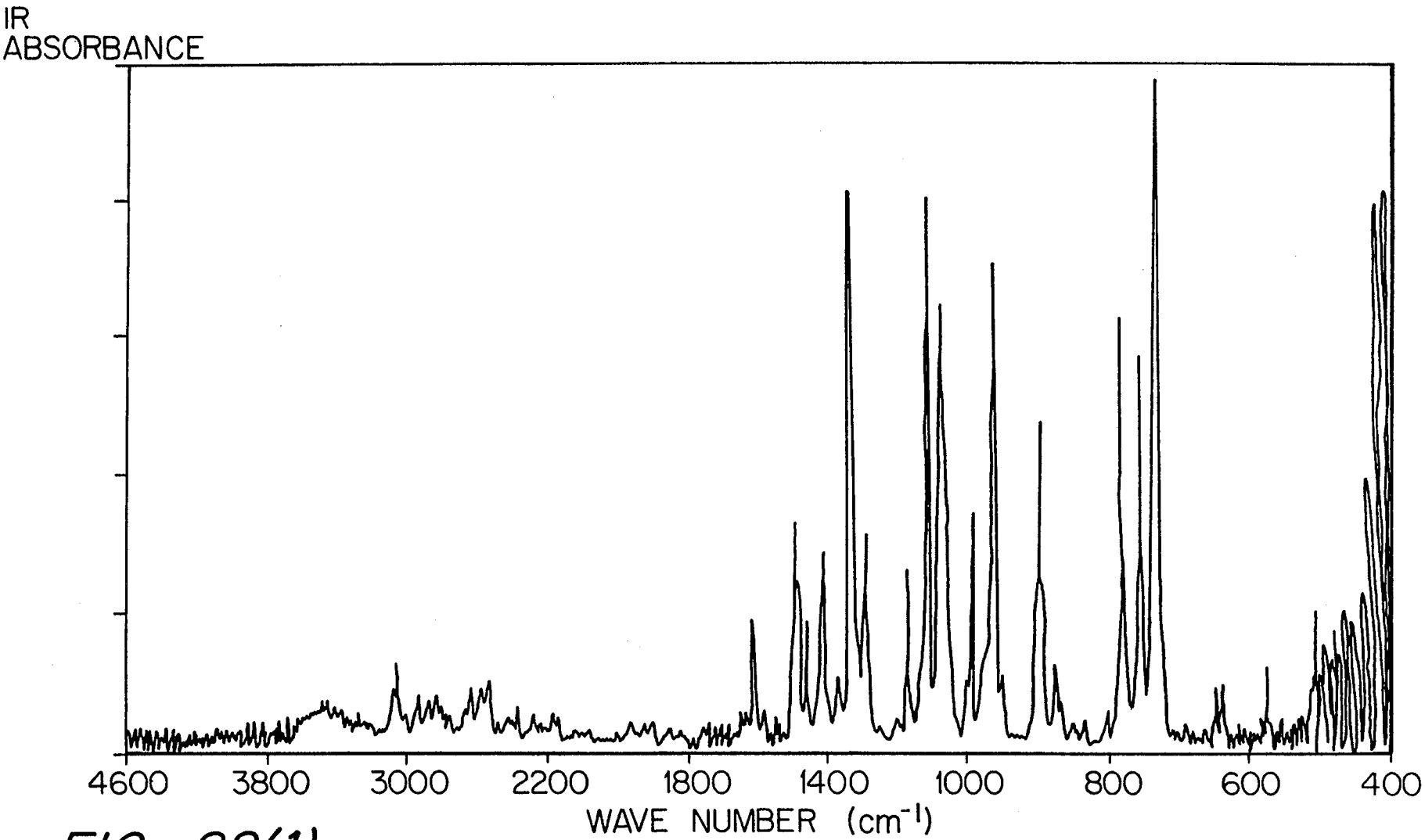

The paste was mixed with 50 g of o-dichlorobenzene by stirring for 2 hours at 50° C. This reaction liquor was diluted with methanol and filtered to obtain crystals. Washing of the crystals with methanol repeated several times gave blue crystals. The crystals had characteristic peaks at Bragg angles ($2\theta$) of 9.5° and 27.2° as shown in FIG. 7 and showed an exothermic peak at 237° C. in differential thermal analysis, and thereby proved to be a mixed crystals of titanylphthalocyanine and vanadylphthalocyanine according to the invention. As seen in the infrared absorption spectrum of the crystals given in FIG. 22(1), the crystal according to the invention has peculiar absorptions in a region of 950 to 1050 $cm^{-1}$. FIG. 22(2) shows the absorption spectrum within this region in particular. Unlike crystals of comparative synthesis example (1), an absorption peculiar to the crystal of the invention appears at 994 $cm^{-1}$, which is attributed to the absorption of the V=O bond in vanadylphthalocyanine. Another absorption observed at 961 $cm^{-1}$ is thought to be an absorption attributable to the Ti=O bond in titanylphthalocyanine, which is also seen for crystals of comparative synthesis example (3). As described above, the titanylphthalocyanine-vanadylphthalocyanine mixed crystals of the invention has absorptions resulting from the respective two phthalocyanines independently, and thereby supports the presence of these two phthalocyanines in itself.

Synthesis Example 2

Figure 23:
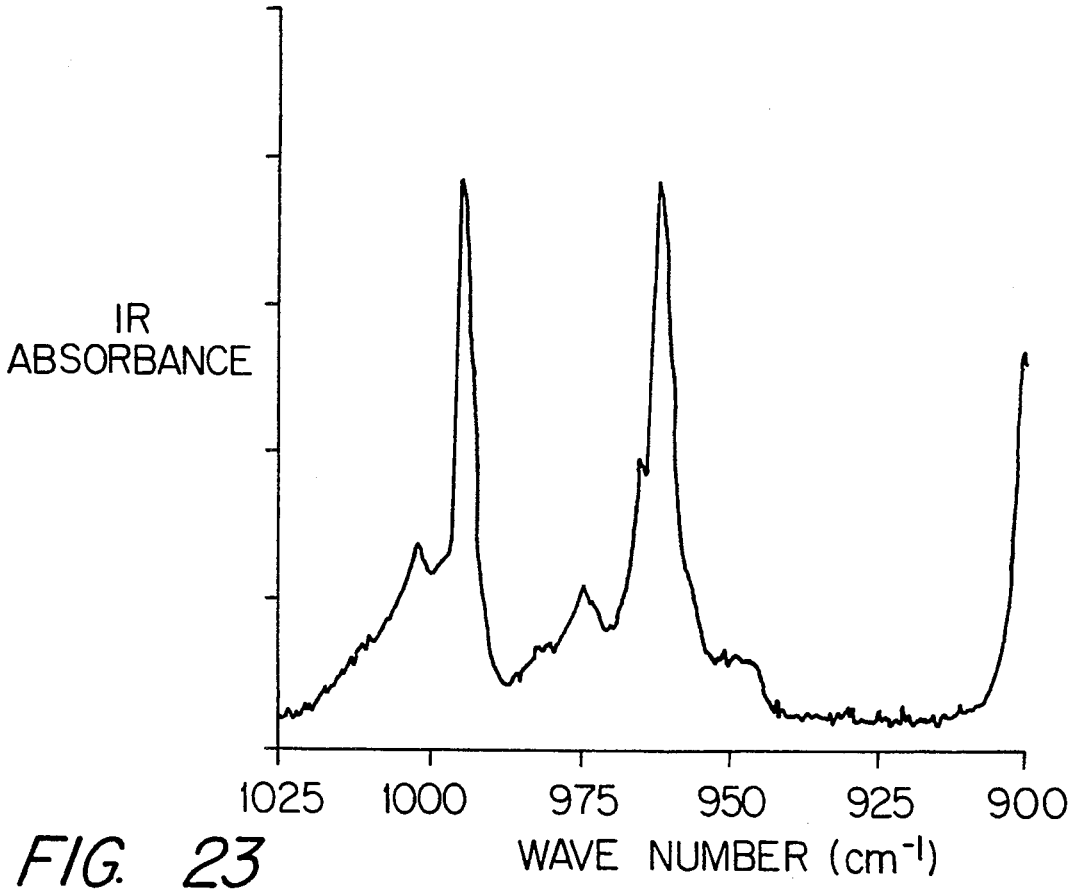

Blue crystals were prepared in the same manner as in Synthesis example 1, except that 2.5 g of titanylphthalocyanine and 2.5 g of vanadylphthalocyanine were used. The crystals had characteristic peaks at Bragg angles ($2\theta$) of 9.5° and 27.2° as shown FIG. 8, and showed an exothermic peak at 228° C. in differential thermal analysis, as well as absorptions at 994 $cm^{-1}$ and 961 $cm^{-1}$ in the infrared absorption spectrum as shown in FIG. 23.

Synthesis Example 3

Figure 9:
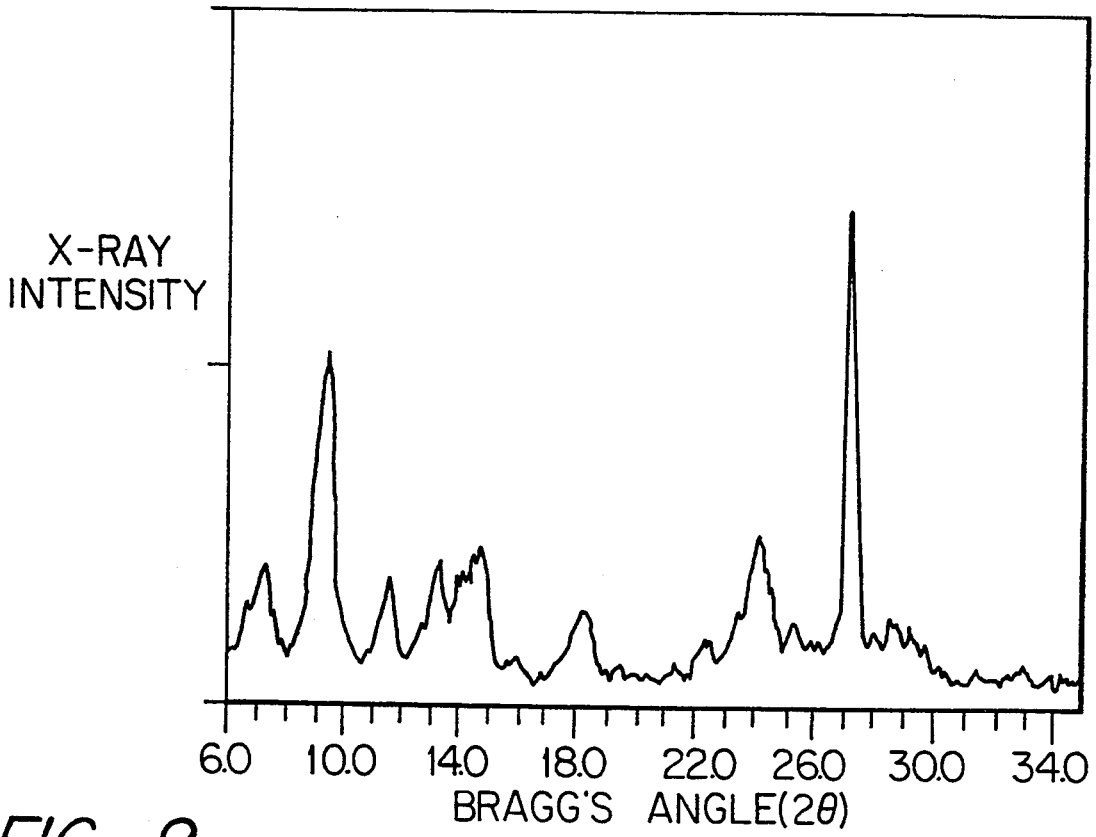
Figure 24:
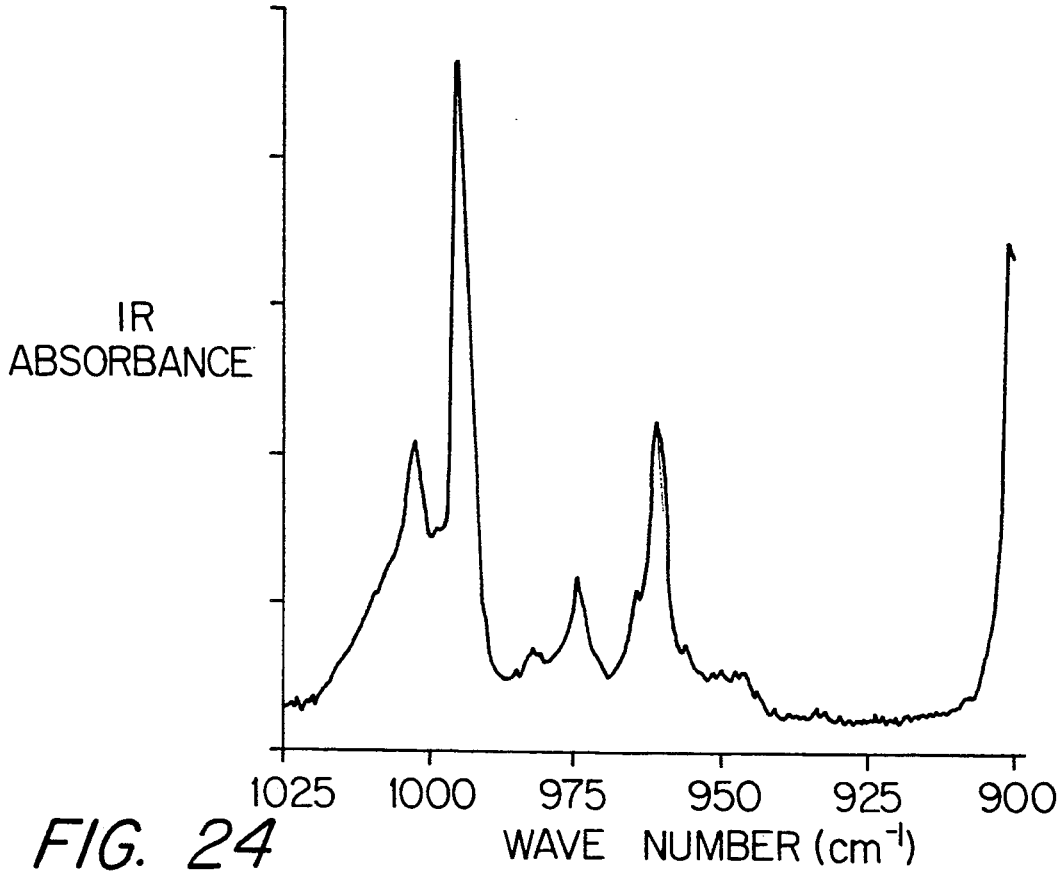

Blue crystals were prepared in the same manner as in Synthesis example 1, except that 1 g of titanylphthalocyanine and 4 g of vanadylphthalocyanine were used. The crystals had characteristic peaks at Bragg angles ($2\theta$) of 9.5° and 27.2° as shown in FIG. 9, and showed an exothermic peak at 219° C. in differential thermal analysis, as well as absorptions at 995 $cm^{-1}$ and 961 $cm^{-1}$ in the infrared absorption spectrum as shown in FIG. 24. The absorption at 995 $cm^{-1}$ is considered to be caused by a bond of V=O.

Synthesis Example 4

Figure 10:
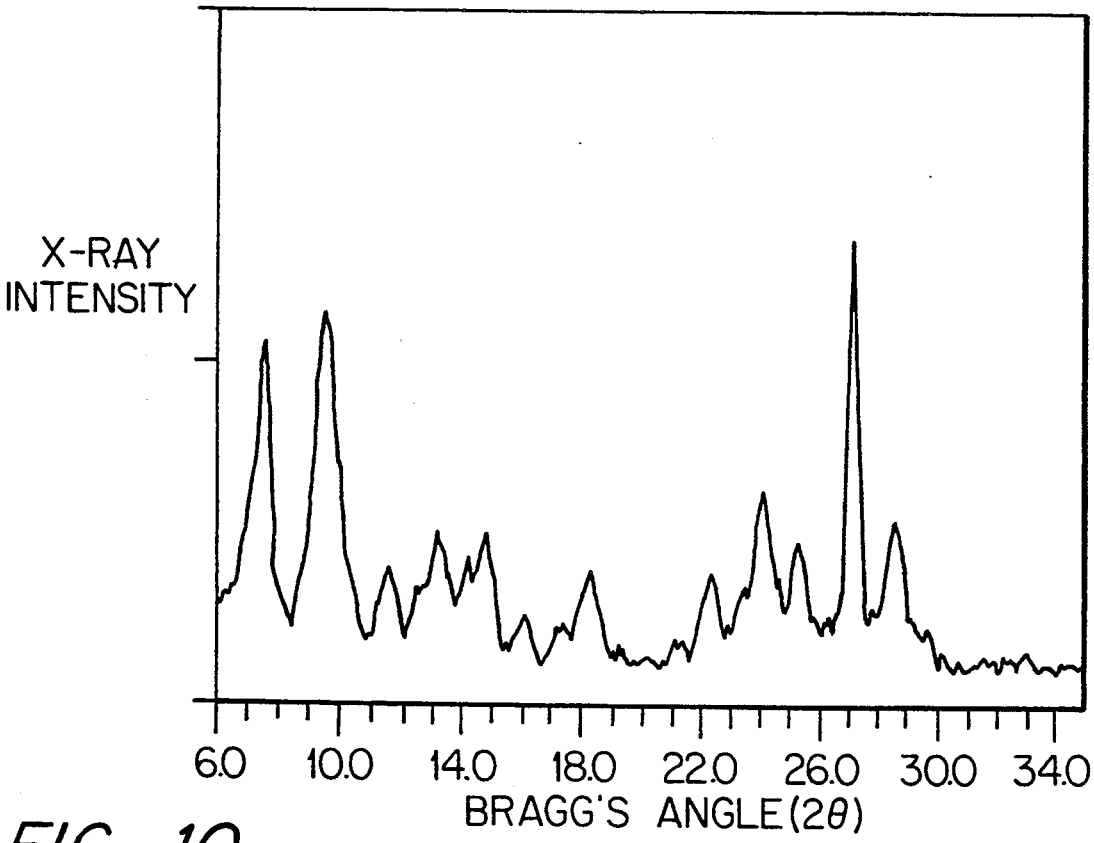
Figure 25:
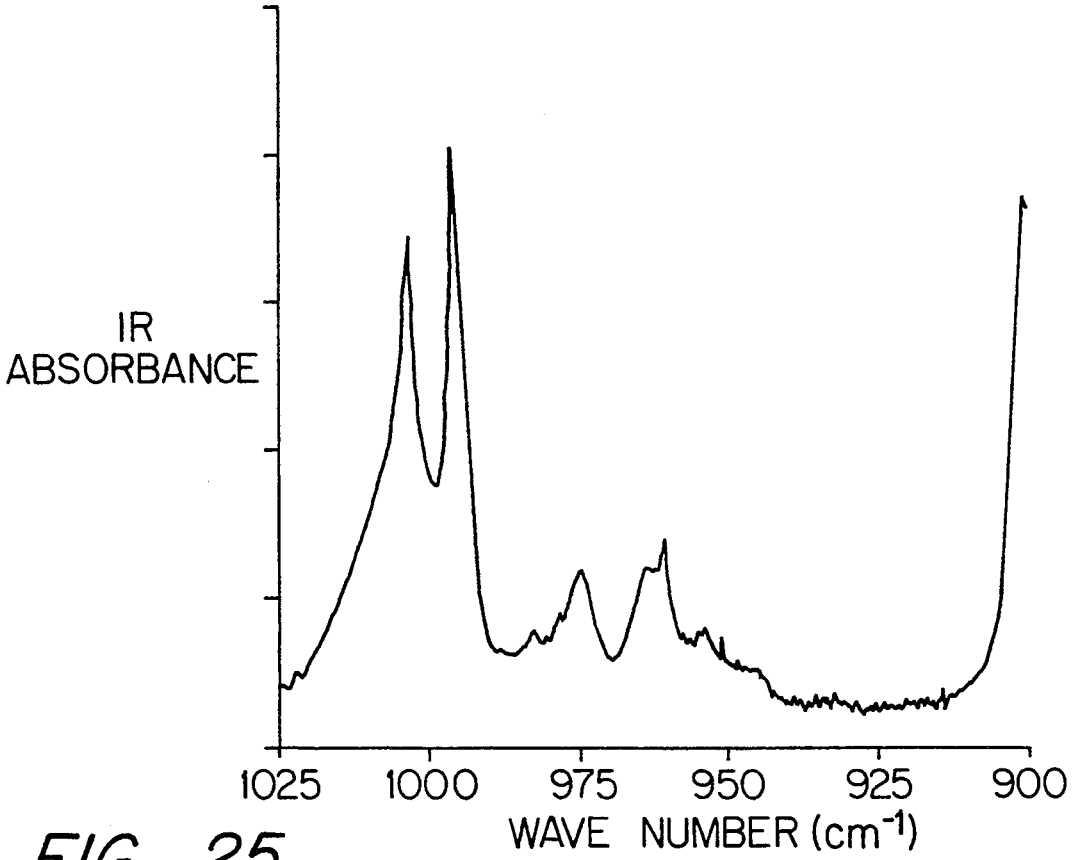

Blue crystals were prepared in the same manner as in Synthesis example 1, except that 0.5 g of titanylphthalocyanine and 4.5 g of vanadylphthalocyanine were used. The crystals had characteristic peaks at Bragg angles ($2\theta$) of 9.5° and 27.2° as shown in FIG. 10, and showed a exothermic peak at 216° C. in differential thermal analysis, as well as absorptions at 1003 $cm^{-1}$, 995 $cm^{-1}$ and 961 $cm^{-1}$ in the infrared absorption spectrum as shown in FIG. 25.

Synthesis Example 5

Figure 11:
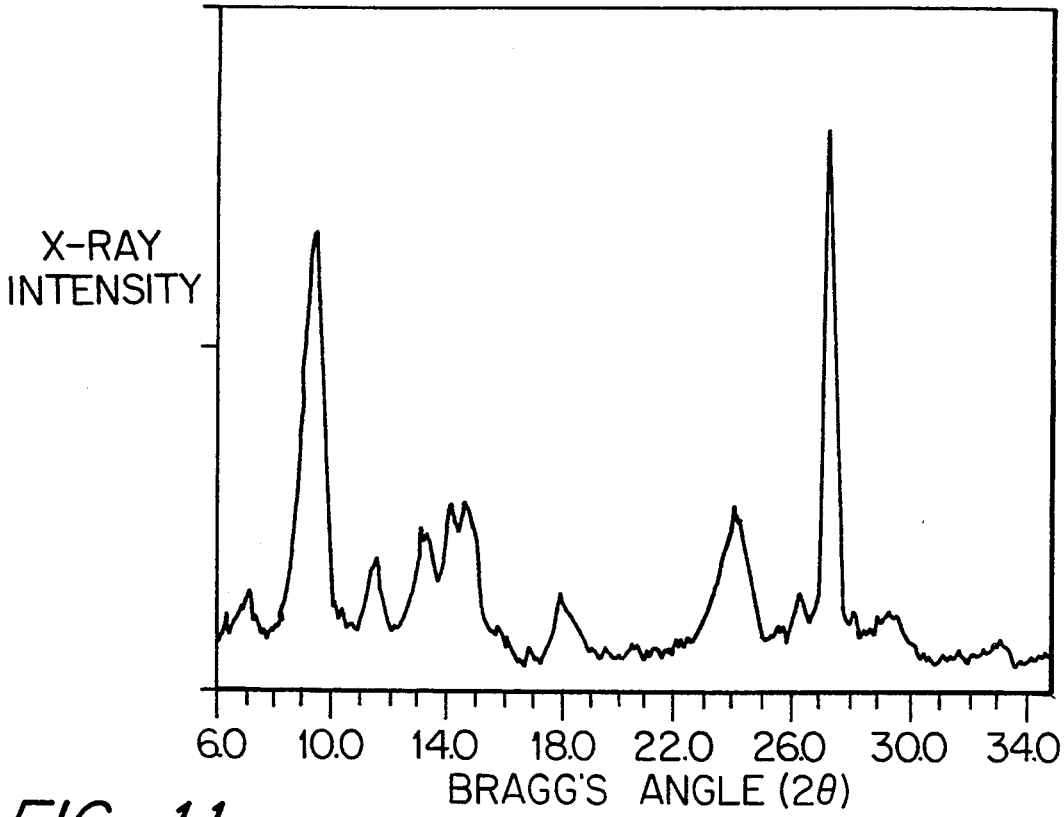

Blue crystals were prepared in the same manner as in Synthesis example 1, except that 4.75 g of titanylphthalocyanine and 0.25 g of vanadylphthalocyanine were used. The crystals had characteristic peaks at Bragg angles ($2\theta$) of 9.5° and 27.2° as shown in FIG. 11, and showed an exothermic peak at 247° C. in differential thermal analysis.

Synthesis Example 6

Figure 8:
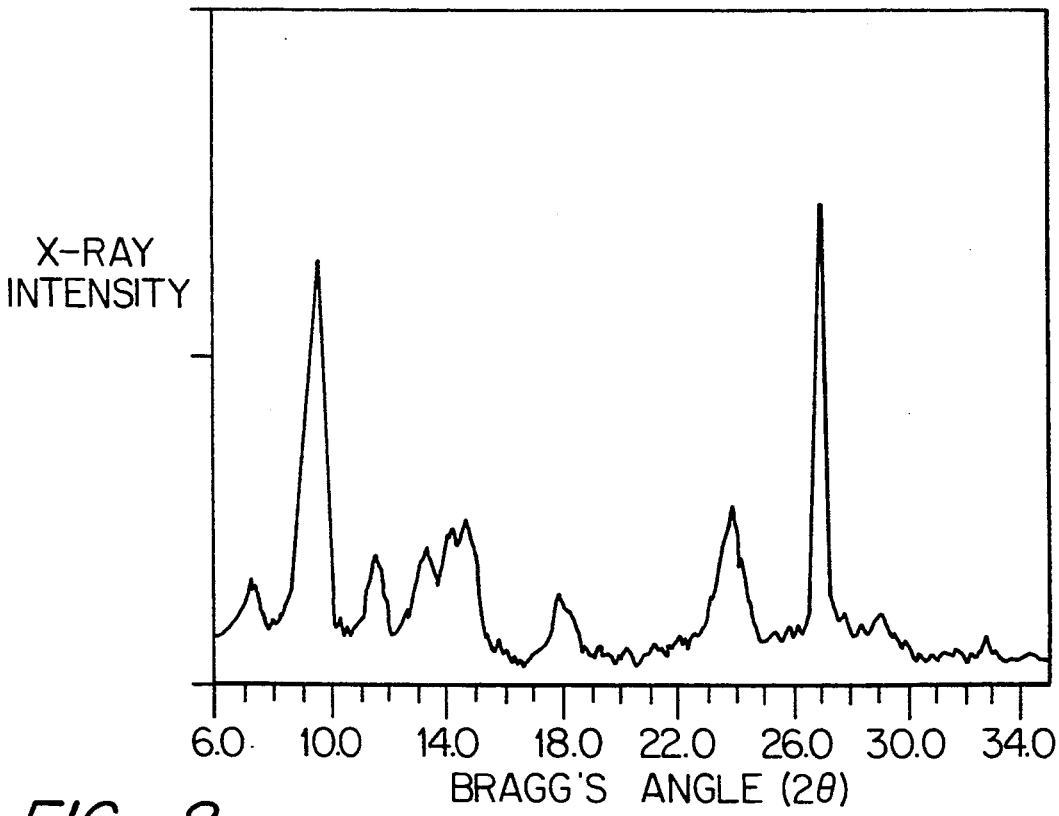
Figure 12:
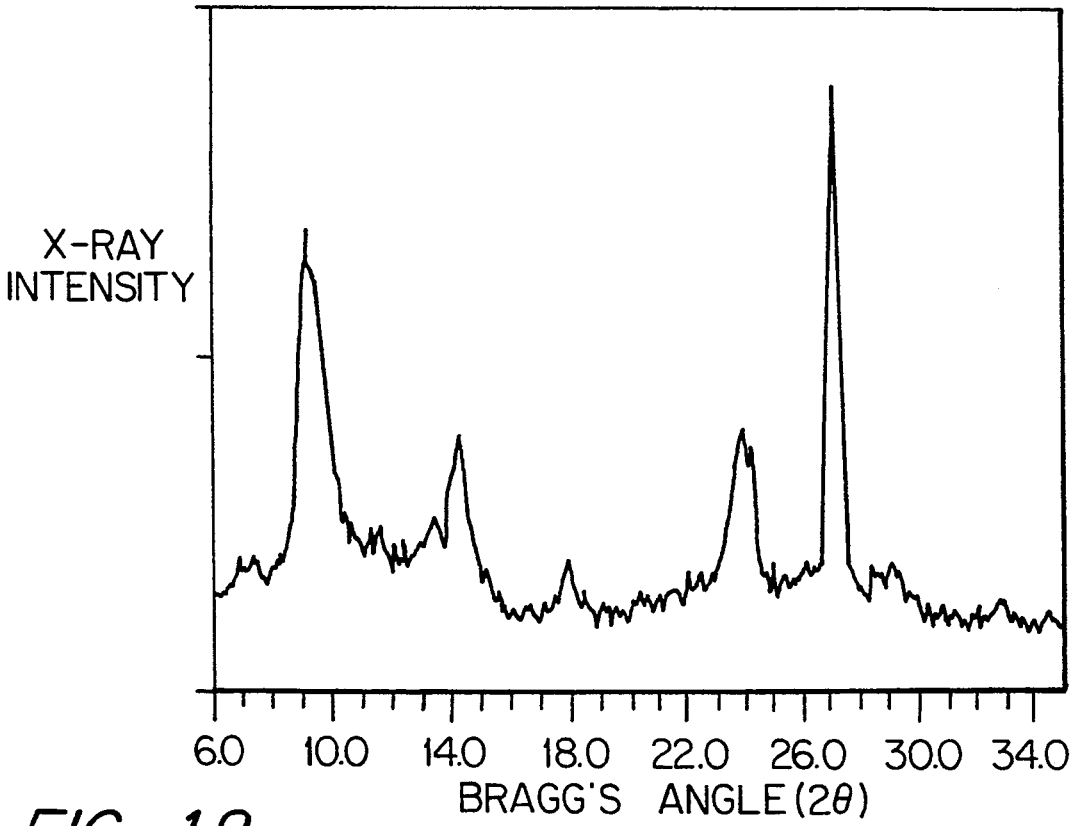
Figure 26:
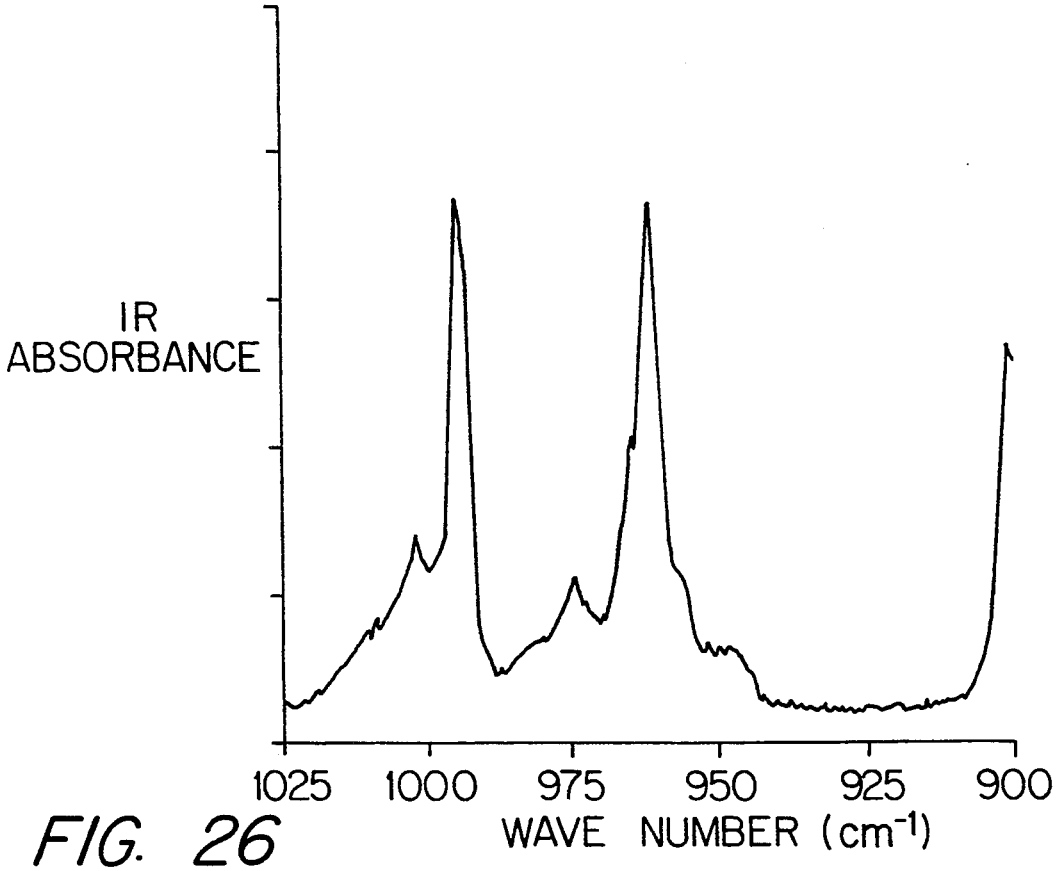
FIGS. 26 and 29 are an infrared absorption spectrum of the titanylphthalocyanine-vanadylphthalocyanine mixed crystals prepared in Synthesis examples 6 and 9, respectively.

A titanylphthalocyanine having characteristic peaks at Bragg angles ($2\theta$) of 9.1° and 27.2° as shown in FIG. 12 was prepared by milling in THF the titanylphthalocyanine-vanadylphthalocyanine mixed crystals of FIG. 8 prepared in Synthesis example 2 and washing the milled crystal with methanol. This titanylphthalocyanine showed an exothermic peak at 300° C. in differential thermal analysis and absorptions at 994 $cm^{-1}$ and 961 $cm^{-1}$ in the infrared absorption spectrum as shown in FIG. 26.

Synthesis Example 7

Figure 13:
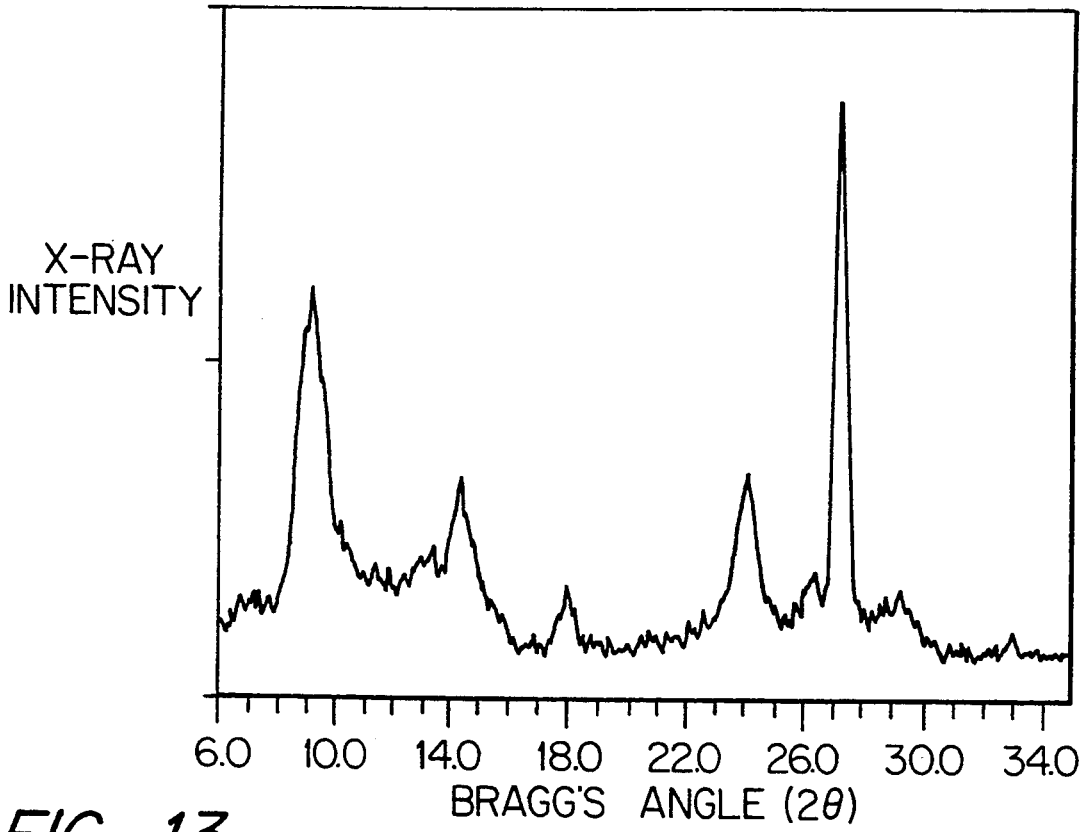
Figure 14:
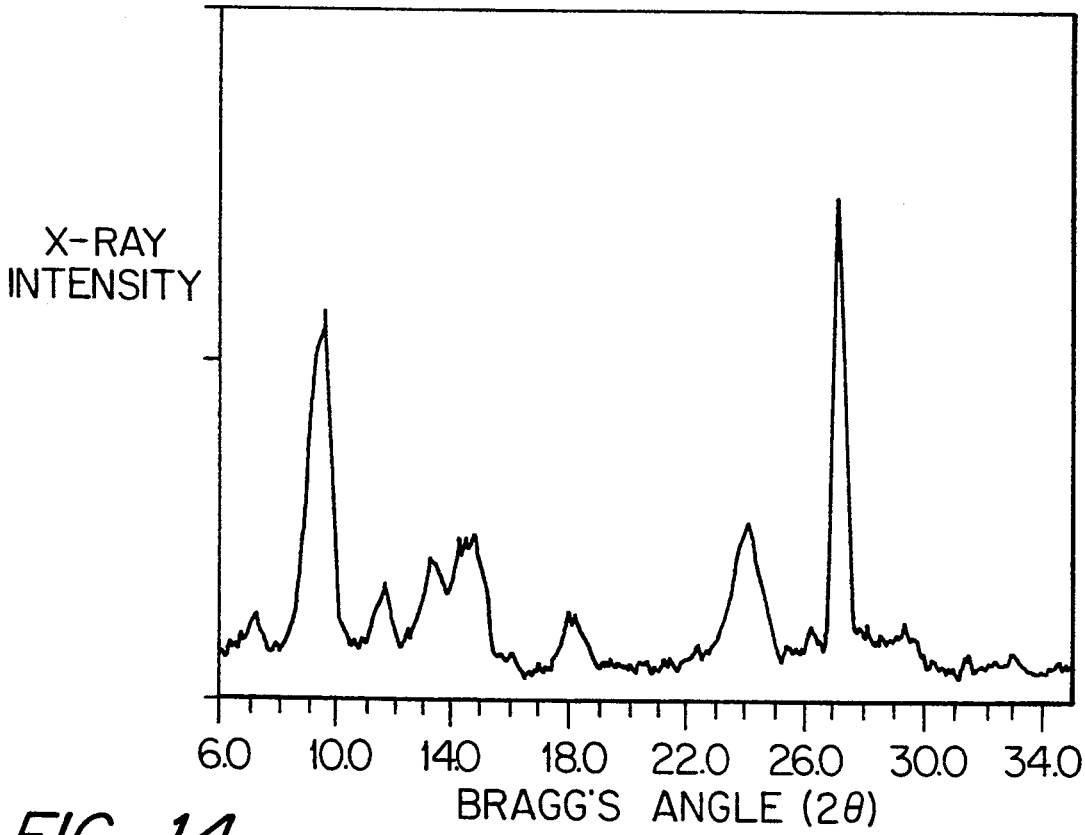

A titanylphthalocyanine having characteristic peaks at Bragg angles (2θ) of 9.1° and 27.2° as shown in FIG. 13 was prepared by milling in THF the titanylphthalocyanine-vanadylphthalocyanine mixed crystals of FIG. 9 prepared in Synthesis example 3 and washing the milled crystal with methanol. This titanylphthalocyanine showed an exothermic peak at 248° C. in differential thermal analysis.

Synthesis Example 8

Figure 29:
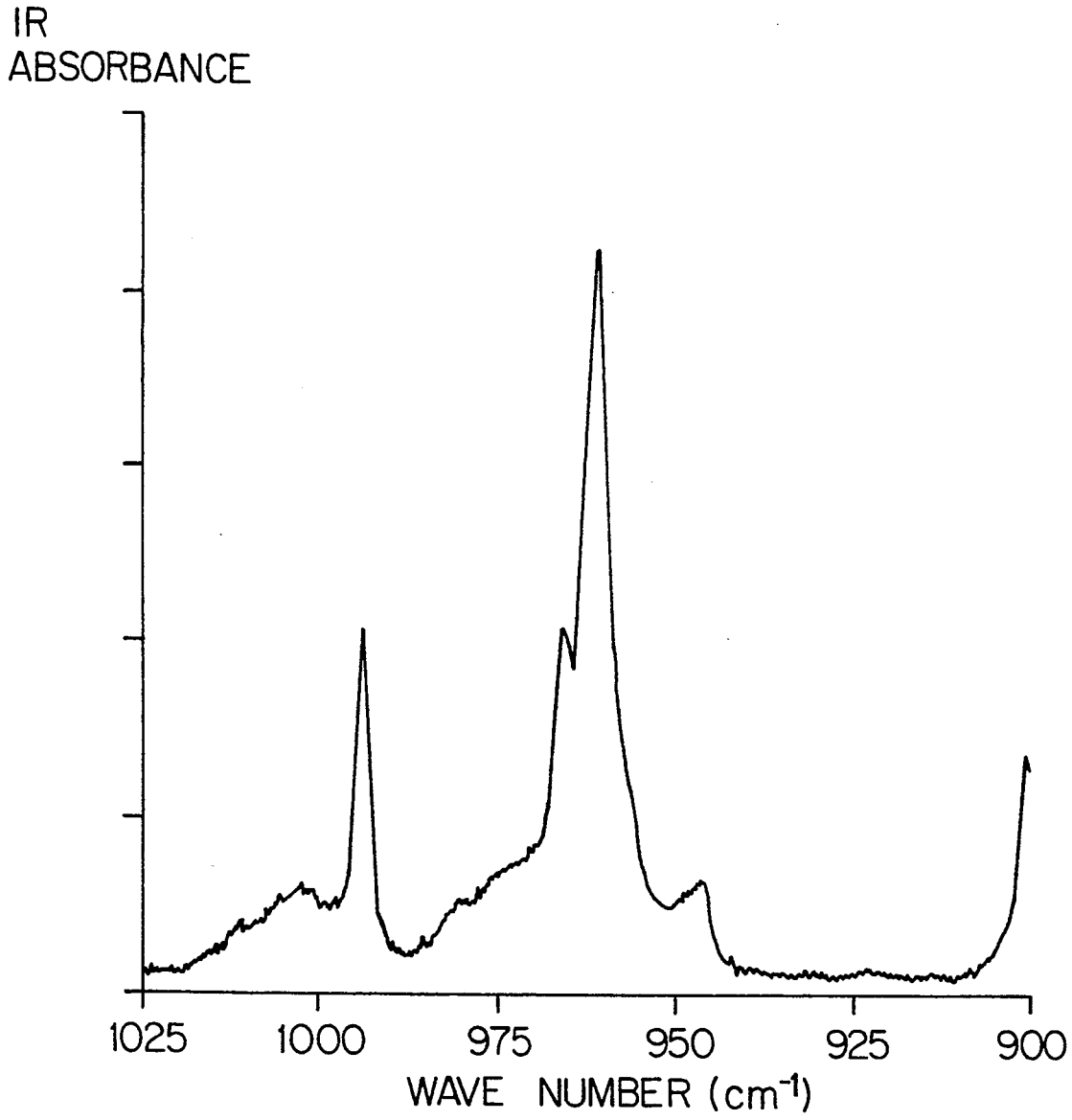

Titanylphthalocyanine-vanadylphthalocyanine mixed crystals was prepared in the same procedure as in Synthesis example 1, except that 0.5 g of tetra-t-butyl titanylphthalocyanine was used in addition to 4 g of titanylphthalocyanine and 1 g of vanadylphthalocyanine used in Synthesis example 1. These crystals had characteristic peaks at Bragg angles (2θ) of 9.5° and 27.2°. But these crystals did not show a clear exothermic peak in differential thermal analysis, they showed only an obscurely broadened peak. This titanylphthalocyanine showed absorptions at 994 $cm^{-1}$ and 961 $cm^{-1}$ in the infrared absorption spectrum as shown in FIG. 29.

Synthesis Example 9

A composition comprised of amorphous titanylphthalocyanine and vanadylphthalocyanine was prepared by mixing enough 4 g of titanylphthalocyanine and 1 g of vanadylphthalocyanine in a mortar, then grinding the mixture till clear characteristic peaks disappeared in X-ray diffraction with an automated mortar. The composition was washed with methanol and then stirred adequately in 50 liters of water, followed by a further stirring for 2 hours at 50° C. accompanied with the addition of 50 g of o-dichlorobenzene to obtain a solution. The solution was diluted with methanol to deposit crystals, which were then filtered out and washed several times with methanol to obtain blue crystals. These crystals had characteristic peaks at Bragg angles (2θ) of 9.5° and 27.2° and showed a exothermic peak at 237° C. in differential thermal analysis.

Comparative Synthesis Example 1

Using non-recrystallized crude crystals prepared by reaction between 1,3-diiminoisoindoline and vanadylacetyl acetate as vanadylphthalocyanine, an amorphous wet paste was obtained in a similar manner as in Synthesis example 1. That is, 5 g of the crude crystals were dissolved in 250 g of 96% sulfuric acid under cooling with iced-water, and the solution was poured into 5 liters of water, the paste deposited was then filtered out.

Figure 15:
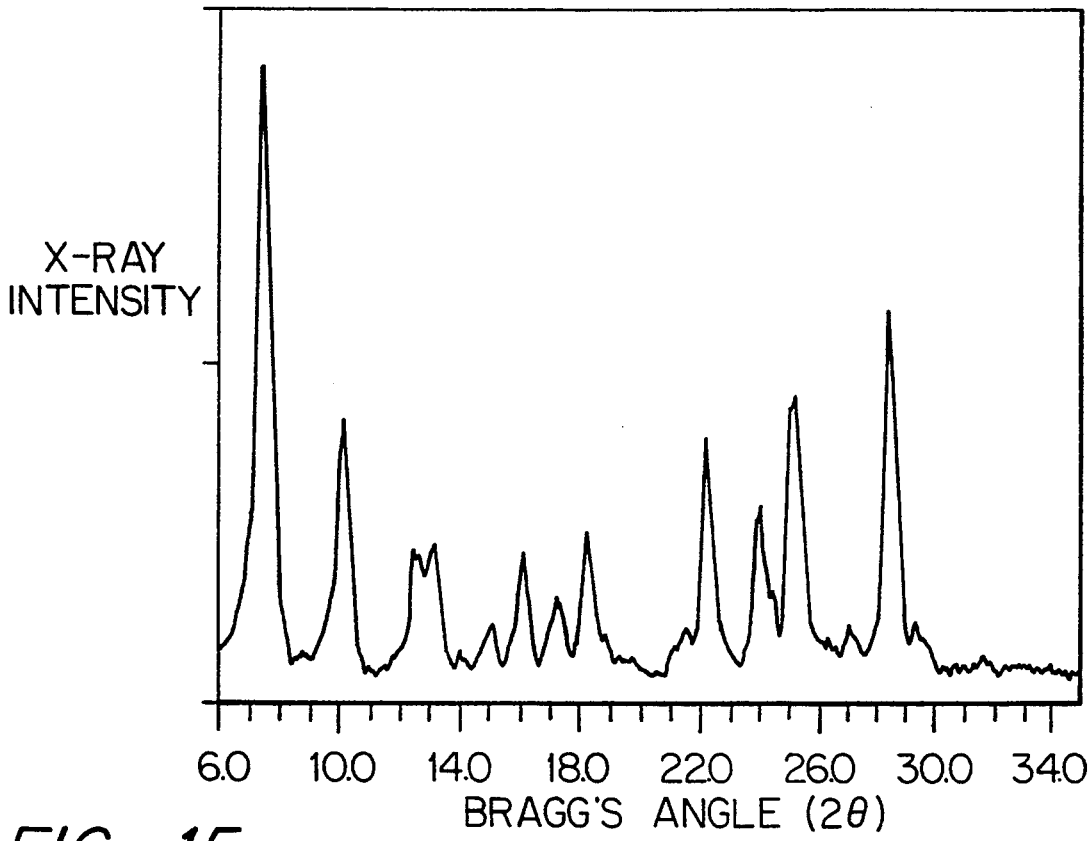
FIGS. 15 to 20 are X-ray diffraction spectra of the titanylphthalocyanines or vanadylphthalocyanines respectively prepared in Comparative synthesis examples (1) to (6).
Figure 27:
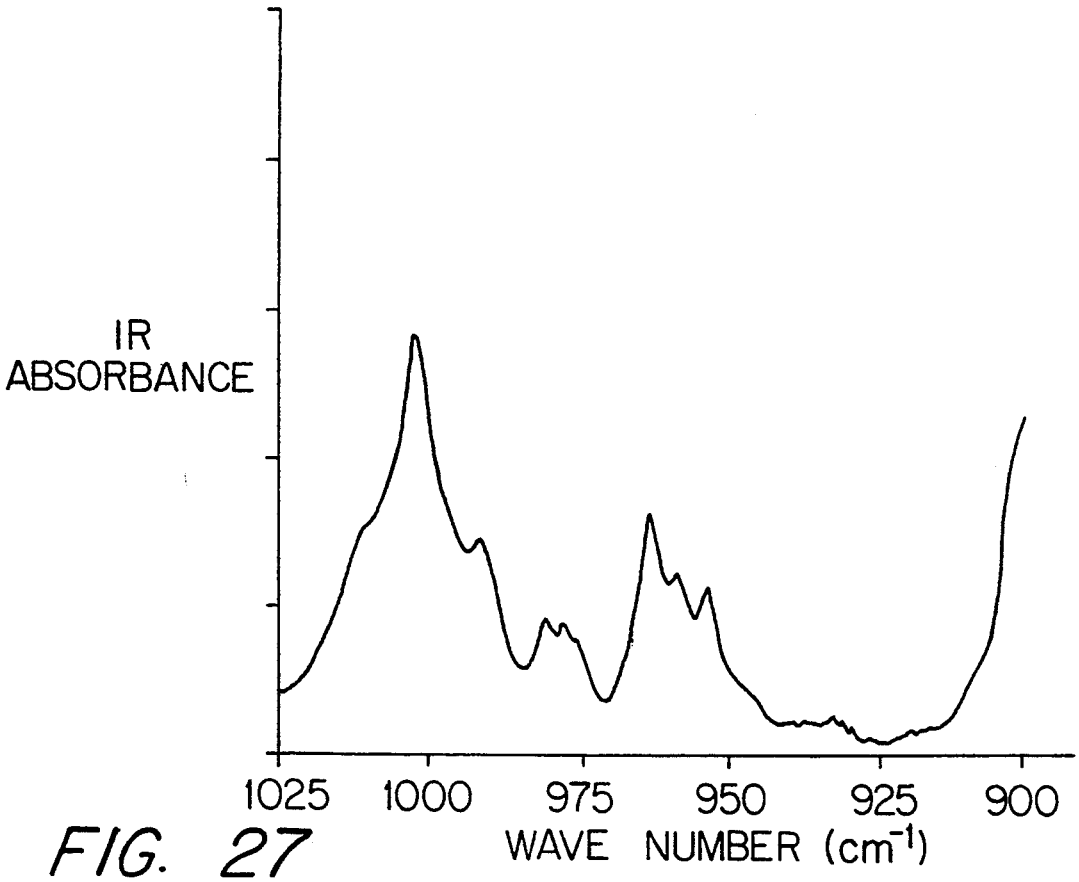
FIG. 27 is an infrared absorption spectrum of the vanadylphthalocyanine prepared in Comparative synthesis example (1).

This wet paste was mixed with 50 g of o-dichlorobenzene and stirred for 2 hours at 50° C. Then, this reaction liquor was diluted with methanol to form crystals, which were filtered out and washed with methanol several times. Blue crystals thus obtained had characteristic peaks at Bragg angles (2θ) of 7.5°, 9.5°. 27.2° and 28.6° as shown in FIG. 15, but did not show any clear exothermic peak in differential thermal analysis. In an infrared absorption spectrum, an absorption was observed at 1003 $cm^{-1}$ as shown in FIG. 27.

Comparative Synthesis Example 2

Figure 16:
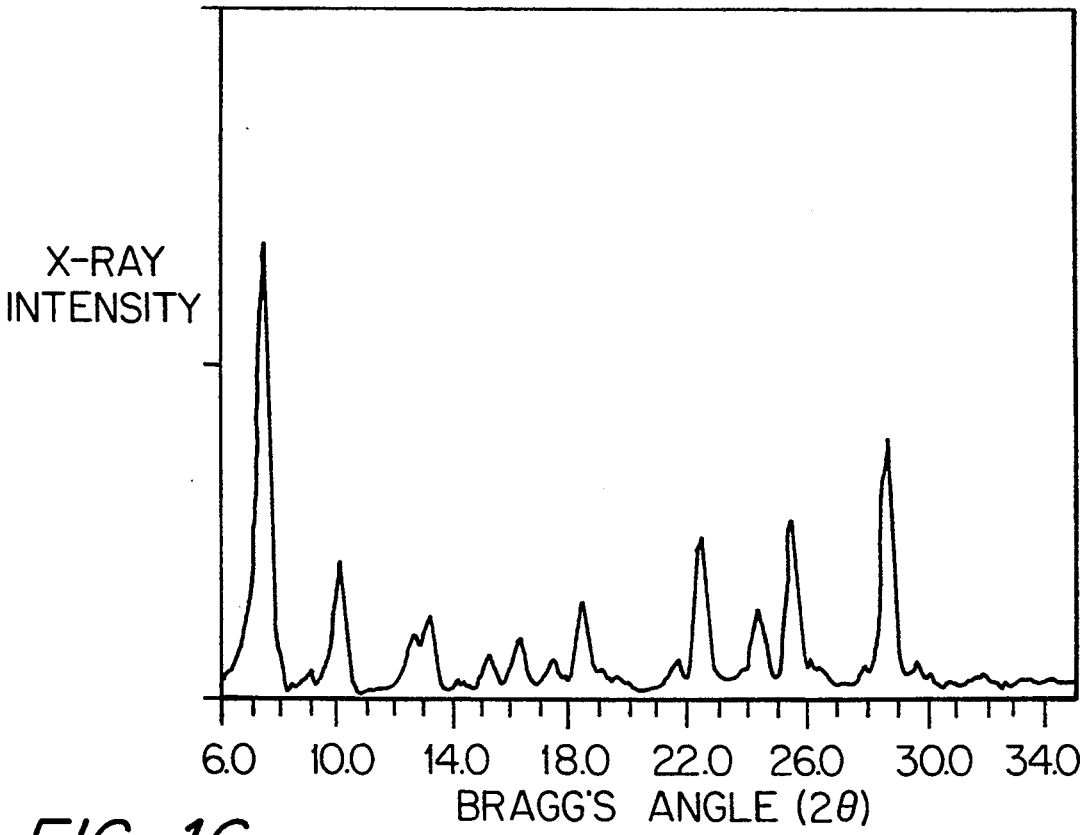

Blue crystals were obtained in the same manner as in Comparative synthesis example 1, except that a vanadylphthalocyanine refined by recrystallization from 1-chloronaphthalne was used as the vanadylphthalocyanine. The crystals had characteristic peaks at Bragg angles (2θ) of 7.5° and 28.6° as shown in FIG. 16, but did not show any clear exothermic peak in differential thermal analysis. In the infrared absorption spectrum, an absorption was observed at 1003 $cm^{-1}$.

Comparative Synthesis Example 3

Figure 17:
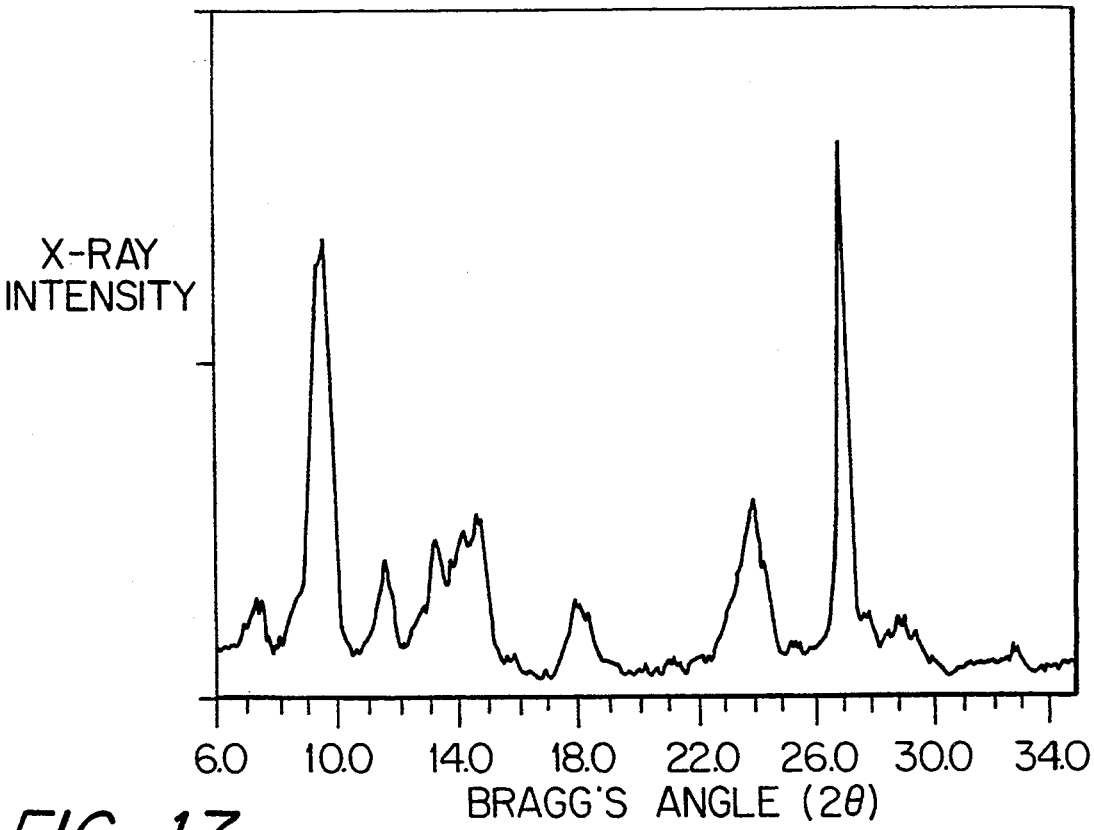
Figure 28:
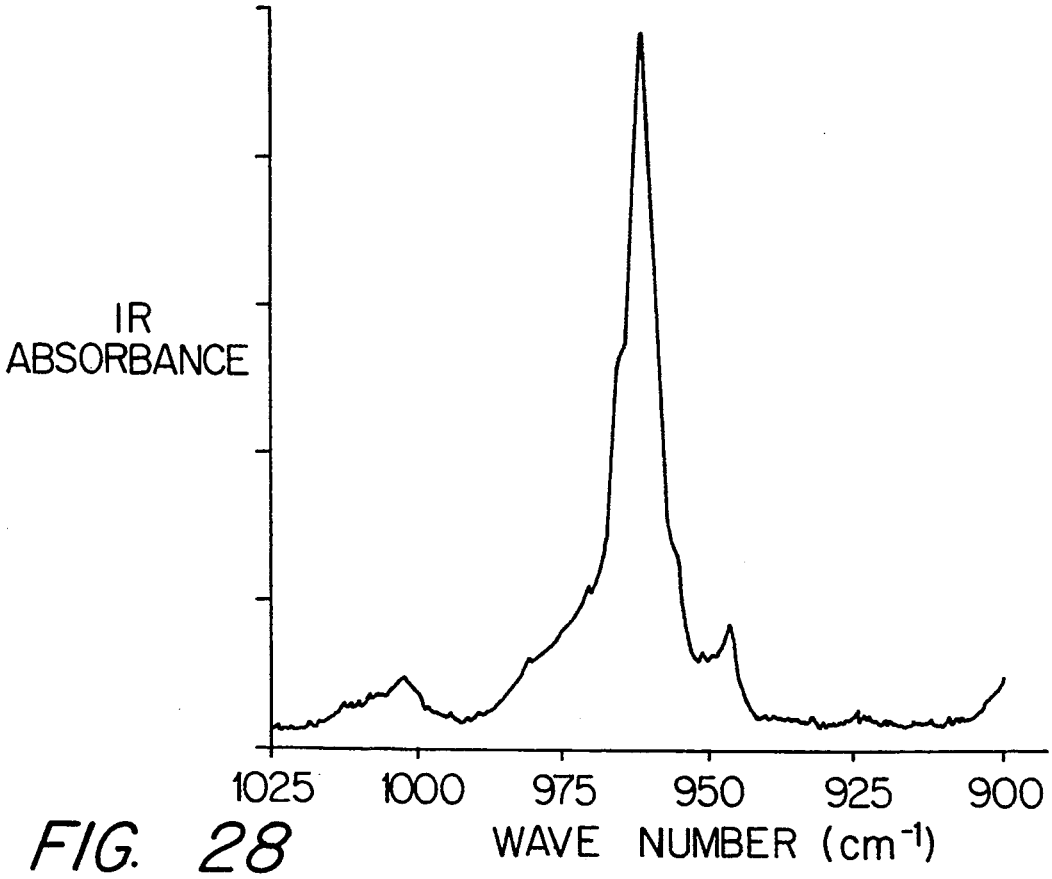
FIG. 28 and is an infrared absorption spectrum of the titanylphthalocyanine prepared in Comparative synthesis example (3).

Blue crystals were obtained in the same manner as in Comparative synthesis example 1, except that the titanylphthalocyanine prepared in the above synthesis example was used in place of the vanadylphthalocyanine. The crystals proved to be a titanylphthalocyanine having characteristic peaks at Bragg angles (2θ) of 9.5° and 27.2° shown in FIG. 17 and showing an exothermic peak at 255° C. in differential thermal analysis. Further, an absorption was observed at 961 $cm^{-1}$ in the infrared absorption spectrum as shown in FIG. 28.

Comparative Synthesis Example 4

Figure 18:
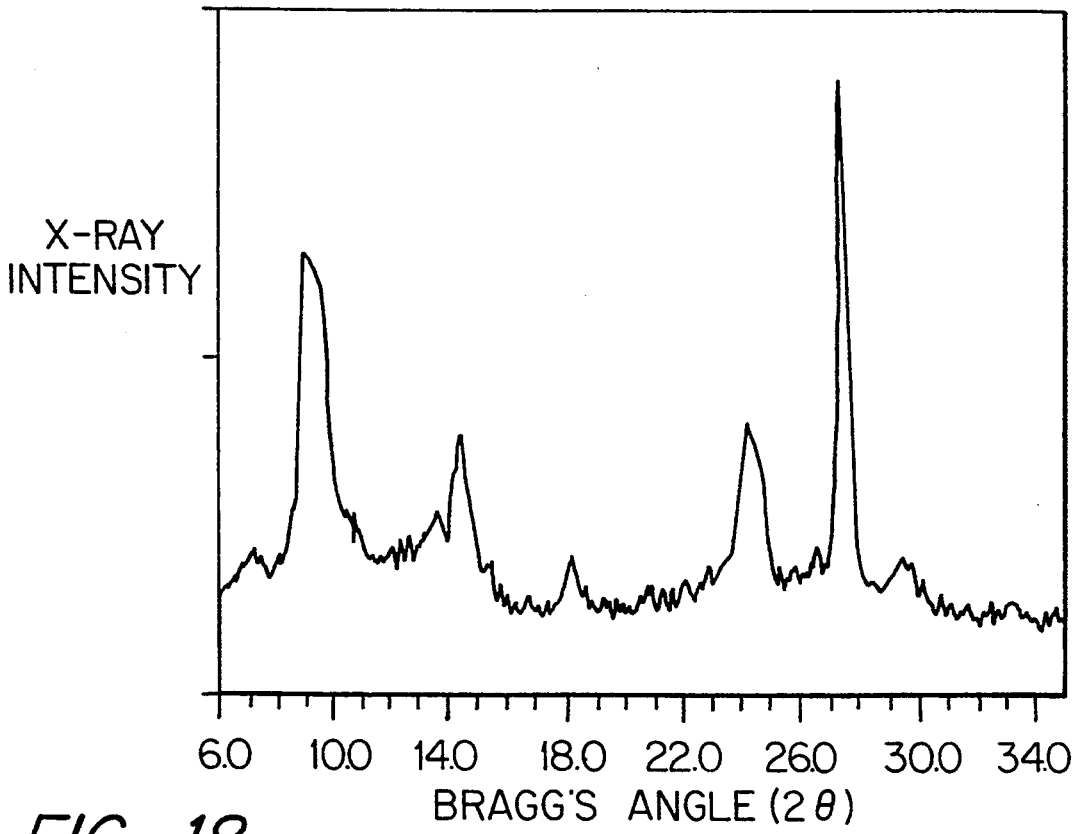

Blue crystals were obtained by milling in THF the titanylphthalocyanine prepared in Comparative synthesis example 4 and washing the milled crystals. The crystals proved to be a titanylphthalocyanine having characteristic peaks at Bragg angles (2θ) of 9.0° and 27.2° as shown in FIG. 18 and showing an exothermic peak at 361° C. in differential thermal analysis.

Comparative Synthesis Example 5

Figure 19:
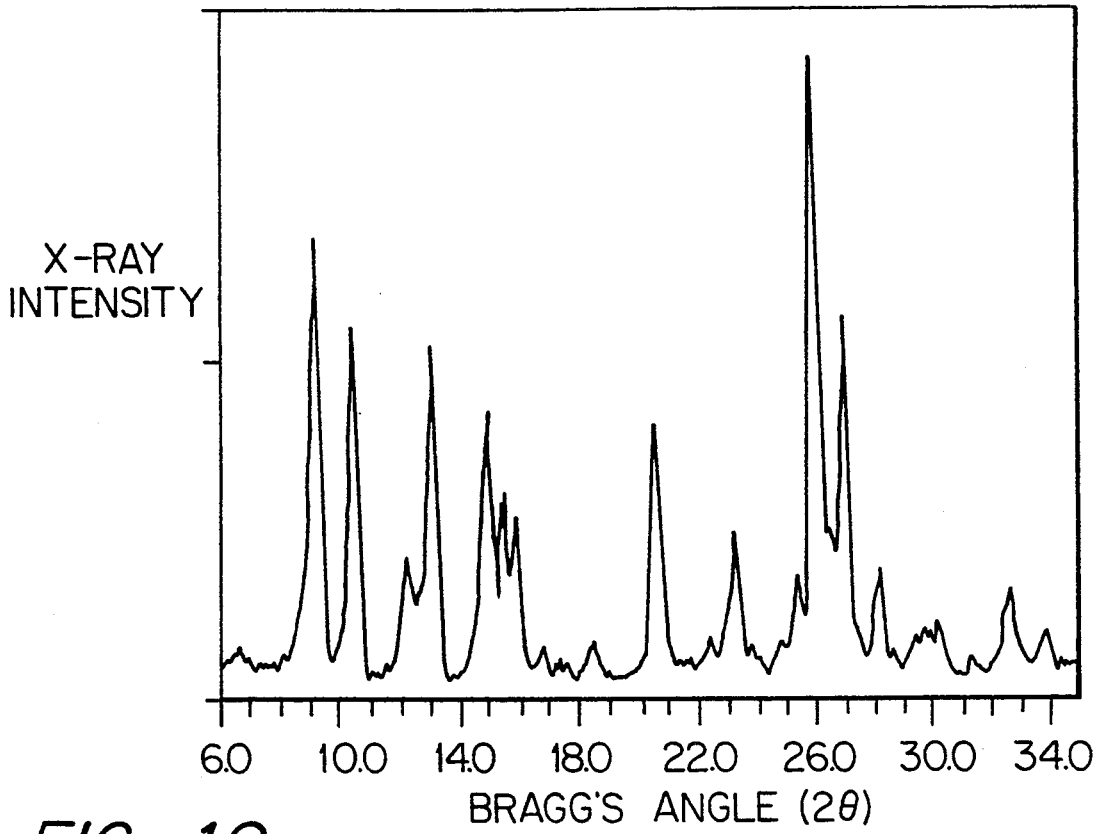
Figure 20:
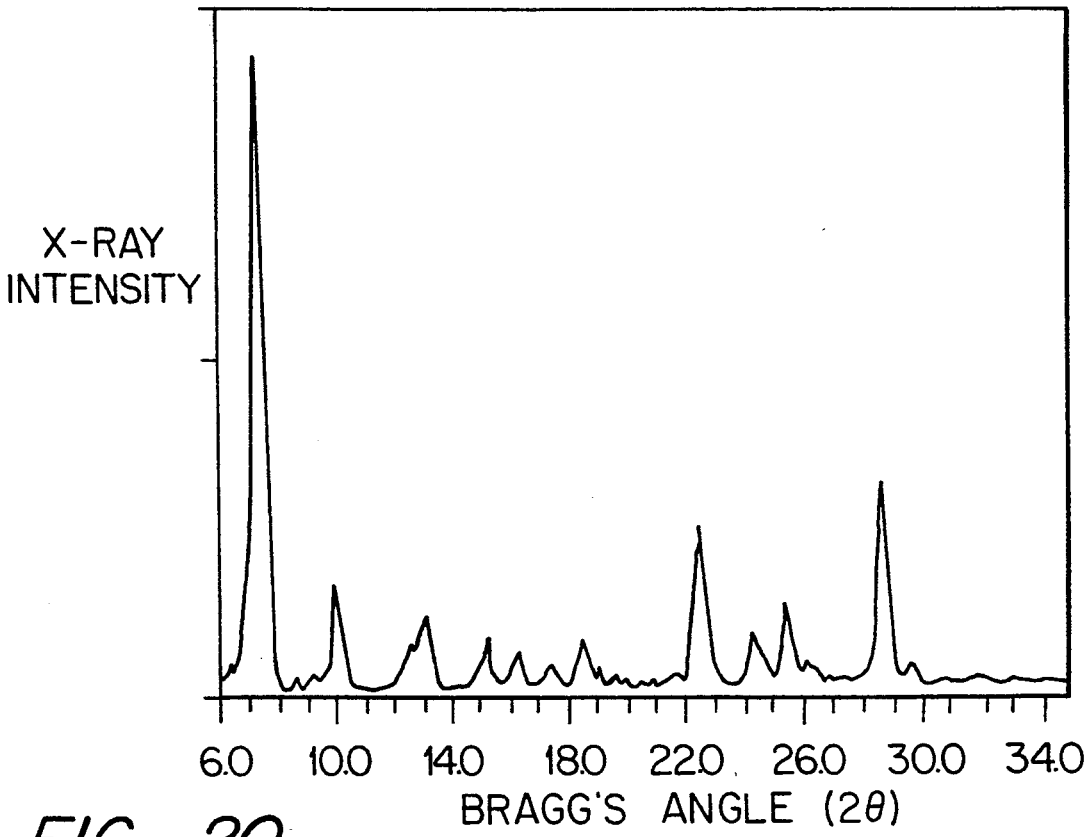

The wet paste obtained in Synthesis example 1 was dried to powder. Recrystallization of this powder from 1-chloronaphthalene gave type-A crystals having characteristic peaks at Bragg angles (2θ) of 9.2°, 10.5°, 13.1°, 15.0°, 26.2° and 27.1° as shown in FIG. 19. The crystals showed no exothermic peak within the range from 150° C. to 400° C. in differential thermal analysis.

Comparative Synthesis Example 6

There was refluxed under heating 2 g of powder prepared by drying the wet paste of Synthesis example 2 in 150 ml of 1,1,2,2-tetrachloroethane. The resultant type-B crystals had characteristic peaks at Bragg angles (2θ) of 7.5° and 28.6°. Differential thermal analysis of these crystals gave no clear exothermic peak in the range of 150° C. to 400° C.

Comparative Synthesis Example 7

There were uniformly mixed in a mortar 2.5 g of the titanylphthalocyanine prepared in Comparative synthesis example 3 and 2.5 g of the vanadylphthalocyanine prepared in Comparative synthesis example 1, under conditions not to cause crystal transition. Differential thermal analysis of this mixture gave an exothermic peak at 255° C., which agreed with that of the titanylphthalocyanine prepared in Comparative synthesis example 3. In addition, the mixture showed, in the infrared absorption spectrum, absorption peaks at 961 $cm^{-1}$ and 1003 $cm^{-1}$ corresponding to those of the titanylphthalocyanine of Comparative synthesis example 3 and the vanadylphthalocyanine of Comparative synthesis example 1, respectively. But, the peak at 994 $cm^{-1}$ seen for one prepared in Comparative synthesis example 2 was not observed.

Comparative Synthesis Example 8

In a mortar were uniformly mixed 2.5 g of the titanylphthalocyanine prepared in Comparative synthesis example 2 and a vanadylphthalocyanine made amorphous by acid treatment, under conditions not to cause crystal transition. Differential thermal analysis of this mixture gave exothermic peaks at 255° C. and 240° C., which agreed with those of the titanylphthalocyanine of Comparative synthesis example 3 and a vanadylphthalocyanine made amorphous, respectively. Further, absorption peaks were observed in the infrared absorption spectrum at 961 $cm^{-1}$ and 998 $cm^{-1}$, which agreed with those of the titanylphthalocyanine of Comparative synthesis example 3 and a vanadylphthalocyanine made amorphous, respectively. But, the peak at 994 $cm^{-1}$ seen in Synthesis example 2 was not observed.

Comparative Synthesis Example 9

Figure 21:
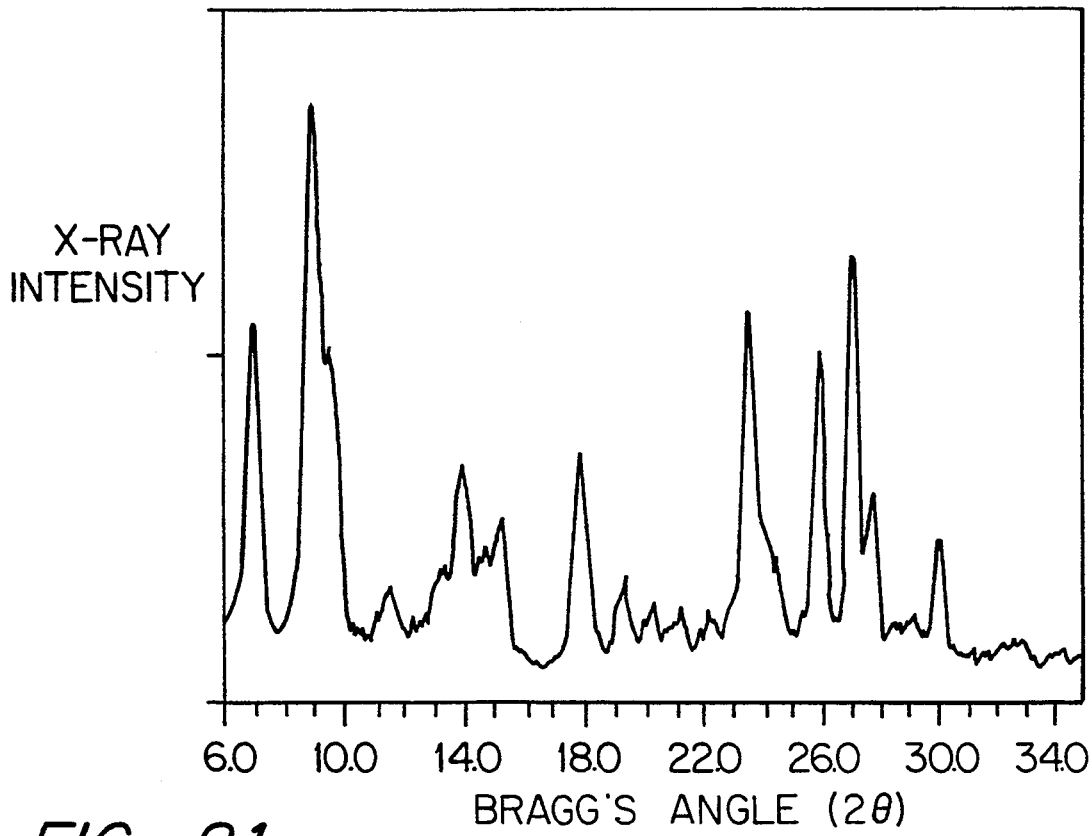
FIG. 21 is an X-ray diffraction spectrum of the mixture of titanylphthalocyanine and nonmetal phthalocyanine prepared in Comparative synthesis example (9).

A sample was prepared in the same manner as in Synthesis example 2, except that nonmetal phthalocyanine was used in place of the vanadylphthalocyanine. FIG. 21 shows the result of X-ray diffraction of this sample, in which a characteristic peak corresponding to that of nonmetal phthalocyanine type-B is observed in addition to characteristic peaks at 9.5° and 27.2° peculiar to the crystal of the invention. In differential thermal analysis of the sample, an exothermic peak was observed at 255° C. as seen in Comparative synthesis example 3, this exothermic peak was identical with that of a single titanylphthalocyanine. It is understood from these results that no mixed crystals were formed between the titanylphthalocyanine and the nonmetal phthalocyanine, and that the titanylphthalocyanine was converted into type-Y, the nonmetal phthalocyanine into type-$\beta$, and these two converted types were mixed in the sample.

Comparative Synthesis Example 10

A sample was prepared in the same procedure as in Synthesis example 1, except that the copper phthalocyanine derivative denoted by Synthesis example No. 4-c in Japanese Pat. O.P.I. Pub. No. 9962/1991 was used in place of the vanadylphthalocyanine. X-ray diffraction of this sample gave characteristic peaks at Bragg angles ($2\theta$) of 9.5° and 27.2° In the infrared absorption spectrum, an absorption was observed at 961 $cm^{-1}$ but no absorption was found in the vicinity of 994 $cm^{-1}$.

Comparative Synthesis Example 11

A sample was prepared in the same manner as in Synthesis example 1, except that the nonmetal tetrachlorophthalocyanine denoted by Synthesis example No. 8-a in Japanese Pat. O.P.I. Pub. No. 9962/1991 was used in place of the vanadylphthalocyanine. In the X-ray diffraction spectrum, this sample also had characteristic peaks at Bragg angles ($2\theta$) of 9.5° and 27.2°. In differential thermal analysis, the sample showed the same exothermic peak of 255° C. as that in Comparative synthesis example 3, which was identical to the value for titanylphthyalocyanine only. An absorption was observed at 961 $cm^{-1}$ in the infrared absorption spectrum, but no absorption was observed in the vicinity of 994 $cm^{-1}$.

Preparation of Photoreceptor

EXAMPLE 1

A dispersion was prepared by dispersing, in a sand mill, 1 part of the titanylphthalocyanine-vanadylphthalocyanine mixed crystals obtained in Synthesis example 1 and 1 part by solid weight of binder resin, silicone resin KR-5240 made by Shin-Etsu Chemical (15% active xylene-butanol solution), in 100 parts of dispersion medium, methyl ethyl ketone. Then, the dispersion was coated on an aluminum-deposited polyester substrate to form a 0.2 $\mu m$ thick carrier generation layer.

Subsequently, a 20 $\mu m$ thick carrier transfer layer was formed thereon by coating with a blade coater a coating solution prepared by dissolving 1 part of carrier transfer material (17), 1.3 parts of polycarbonate resin Iupiron Z200 made by Mitsubishi Gas Chemical and small amount of silicone oil KF-54 made by Shin-Etsu Chemical in 10 parts of 1,2-dichloroethane. The photoreceptor prepared as above is referred to as sample 1.

EXAMPLE 2

A photoreceptor, sample 2, was prepared in the same manner as in Example 1, except that the titanylphthalocyanine-vanadylphthalocyanine mixed crystals obtained in Synthesis example 2 was used in place of the titanylphthalocyanine-vanadylphthalocyanine mixed crystals obtained in Synthesis example 1.

EXAMPLE 3

A photoreceptor, sample 3, was prepared in the same manner as in Example 1, except that the titanylphthalocyanine-vanadylphthalocyanine mixed crystals obtained in Synthesis example 3 was used in place of the titanylphthalocyanine-vanadylphthalocyanine mixed crystals obtained in Synthesis example 1.

EXAMPLE 4

A photoreceptor, sample 4, was prepared in the same manner as in Example 1, except that the titanylphthalocyanine-vanadylphthalocyanine mixed crystals obtained in Synthesis example 4 was used in place of the titanylphthalocyanine-vanadylphthalocyanine mixed crystals obtained in Synthesis example 1.

EXAMPLE 5

A photoreceptor, sample 5, was prepared in the same manner as in Example 1, except that the titanylphthalocyanine-vanadylphthalocyanine mixed crystals obtained in Synthesis example 5 was used in place of the titanylphthalocyanine-vanadylphthalocyanine mixed crystals obtained in Synthesis example 1.

EXAMPLE 6

A photoreceptor, sample 6, was prepared in the same manner as in Example 1, except that the titanylphthalocyanine-vanadylphthalocyanine mixed crystals obtained in Synthesis example 6 was used in place of the titanylphthalocyanine-vanadylphthalocyanine mixed crystals obtained in Synthesis example 1.

EXAMPLE 7

A photoreceptor, sample 7, was prepared in the same manner as in Example 1, except that the titanylphthalocyanine-vanadylphthalocyanine mixed crystals obtained in Synthesis example 7 was used in place of the titanylphthalocyanine-vanadylphthalocyanine mixed crystals obtained in Synthesis example 1.

EXAMPLE 8

A photoreceptor, sample 8, was prepared in the same manner as in Example 1, except that the titanylphthalocyanine-vanadylphthalocyanine mixed crystals obtained in Synthesis example 8 was used in place of the titanylphthalocyanine-vanadylphthalocyanine mixed crystals obtained in Synthesis example 1.

EXAMPLE 9

A photoreceptor, sample 10, was prepared in the same manner as in Example 1, except that the titanylphthalocyanine-vanadylphthalocyanine mixed crystals obtained in Synthesis example 9 was used in place of the titanylphthalocyanine-vanadylphthalocyanine mixed crystals obtained in Synthesis example 1.

EXAMPLE 10

A 0.5 μm thick subbing layer was formed on an aluminum drum by coating thereon, by the coating method, a solution prepared by dissolving with heating 3 parts of copolymerized polyamide luckamide 5003 made by Dainippon Ink & Chemical in 100 parts of methanol and filtering the solution with a filter of 0.6 μm meshes.

Next, a 0.2 μm thick carrier generation layer was formed on the subbing layer by dip coating of a solution prepared by dispersing, in a sand mill, 3 parts of the titanylphthalocyanine-vanadylphthaocyanine mixed crystals obtained in Synthesis example 1 and 3 parts by solid weight of binder resin, silicone resin KR-5240 made by Shin-Etsu Chemical (15% active xylene-butanol solution), in 100 parts of dispersion medium, methyl ethyl ketone.

Subsequently, a 20 μm thick carrier transfer layer was formed thereon by coating, with a blade coater, a solution prepared by dissolving 1 part of carrier transfer material (15), 1.5 parts of polycarbonate resin Iupiron Z-200 made by Mitsubishi Gas Chemical and a small amount of silicone oil KF-54 made by Shin-Etsu Chemical in 10 parts of 1,2-dichloroethane. The photoreceptor prepared is referred to as sample 10.

EXAMPLE 11

A photoreceptor was prepared in the same manner as in Example 11, except that the titanylphthalocyanine-vanadylphthalocyanine mixed crystals obtained in Synthesis example 2 was used in place of the titanylphthalocyanine-vanadylphthalocyanine mixed crystals obtained in Synthesis example 1, and that carrier transfer material (8) was used instead of carrier transfer material (15). This is referred to as sample 11.

EXAMPLE 12

A photoreceptor was prepared in the same manner as in Example 10, except that the titanylphthalocyanine-vanadylphthalocyanine mixed crystals obtained in Synthesis example 3 were used in place of the titanylphthalocyanine-vanadylphthalocyanine mixed crystals obtained in Synthesis example 1, and that carrier transfer material (12) was used instead of carrier transfer material (15). This is referred to as sample 12.

EXAMPLE 13

A photoreceptor was prepared in the same manner as in Example 10, except that the titanylphthalocyanine-vanadylphthalocyanine mixed crystals obtained in Synthesis example 6 was used in place of the titanylphthalocyanine-vanadylphthalocyanine mixed crystals obtained in Synthesis example 1, and that carrier transfer material (16) was used instead of carrier transfer material (15). This is referred to as sample 13.

EXAMPLE 14

A photoreceptor was prepared in the same manner as in Example 10, except that the titanylphthalocyanine-vanadylphthalocyanine mixed crystals obtained in Synthesis example 2 were used in place of the titanylphthalocyanine-vanadylphthalocyanine mixed crystals obtained in Synthesis example 1, and that carrier transfer material (1) was used instead of carrier transfer material (15). This is referred to as sample 14.

Comparative Example (1)

A photoreceptor was prepared in the same manner as in Example 1, except that the vanadylphthalocyanine obtained in Comparative synthesis example (1) was used in place of the titanylphthalocyanine-vanadylphthalocyanine mixed crystals obtained in Synthesis example 1 and used in Example 1. This is referred to as comparative sample (1).

Comparative Example (2)

A photoreceptor was prepared in the same manner as in Example 1, except that the vanadylphthalocyanine obtained in Comparative synthesis example (2) was used in place of the titanylphthalocyanine-vanadylphthalocyanine mixed crystals obtained in Synthesis example 1. This is referred to as comparative sample (2).

Comparative Example (3)

A photoreceptor was prepared in the same manner as in Example 1, except that the titanylphthalocyanine obtained in Comparative synthesis example (3) was used in place of the titanylphthalocyanine-vanadylphthalocyanine mixed crystals obtained in Synthesis example 1. This is referred to as comparative sample (3).

Comparative Example (4)

A photoreceptor was prepared in the same manner as in Example 10, except that the titanylphthalocyanine obtained in Comparative synthesis example (4) was used in place of the titanylphthalocyanine-vanadylphthalocyanine mixed crystals obtained in Synthesis example 1 and used in Example 10. This is referred to as comparative sample (4).

Comparative Example (5)

A photoreceptor was prepared in the same manner as in Example 1, except that the type-A crystal prepared from the mixed crystals of titanylphthalocyanine and vanadylphthalocyanine in Comparative synthesis example (5) was used in place of the titanylphthalocyanine-vanadylphthalocyanine mixed crystals obtained in Synthesis example 1 and used in Example 1. This is referred to as comparative sample (5).

Comparative Example (6)

A photoreceptor was prepared in the same manner as in Example 1, except that the type-B crystal prepared from the mixed crystals of titanylphthalocyanine and vanadylphthalocyanine in Comparative synthesis example (6) was used in place of the titanylphthalocyanine-vanadylphthalocyanine mixed crystals obtained in Synthesis example 1. This is referred to as comparative sample (6).

Comparative Example (7)

A photoreceptor was prepared in the same manner as in Example 1, except that the mixture of titanylphthalocyanine and vanadylphthalocyanine prepared in Comparative synthesis example (7) was used in place of the titanylphthalocyanine-vanadylphthalocyanine mixed crystals obtained in Synthesis example 1. This is referred to as comparative sample (7).

Comparative Example (8)

A photoreceptor was prepared in the same manner as in Example 1, except that the mixture of titanylphthalocyanine and vanadylphthalocyanine prepared in Comparative synthesis example (8) was used in place of the titanylphthalocyanine-vanadylphthalocyanine mixed crystals obtained in Synthesis example 1. This is referred to as comparative sample (8).

Comparative Example (9)

A photoreceptor was prepared in the same manner as in Example 1, except that the mixture of titanylphthalocyanine and vanadylphthalocyanine prepared in Comparative synthesis example (9) was used in place of the titanylphthalocyanine-vanadylphthalocyanine mixed crystals obtained in Synthesis example 1. This is referred to as comparative sample (9).

Comparative Example (10)

A photoreceptor was prepared in the same manner as in Example 1, except that the composition of titanylphthalocyanine and copper phthalocyanine prepared in Comparative synthesis example (10) was used in place of the titanylphthalocyanine-vanadylphthalocyanine mixed crystals obtained in Synthesis example 1. This is referred to as comparative sample (10).

Comparative Example (11)

A photoreceptor was prepared in the same manner as in Example 1, except that the composition of titanylphthalocyanine and nonmetal phthalocyanine prepared in Comparative synthesis example (11) was used in place of the titanylphthalocyanine-vanadylphthalocyanine mixed crystals obtained in Synthesis example 1. This is referred to as comparative sample (11).

Evaluation

The samples prepared as above were evaluated on a Paper Analyzer Model EPA-8100 made by Kawaguchi Denki as follows. Each sample was first subjected to corona electrification for 5 seconds at $-80\ \mu A$ to measure the surface potentials before and immediately after the electrification, Va and Vi, and then exposed at a surface illuminance of 2 (lux) to determine the exposure E1/2 necessary to make the surface potential 1/2 Vi. Further, the dark attenuation factor D was calculated according to the following equation.

$$D=100\ (Va-Vi)/Va(\%)$$

The results obtained are shown in Table 1

TABLE 1

| Sample No. | Va (V) | Vi (V) | D (%) | El/2 (lux · sec) |
|---|---|---|---|---|
| Sample 1 | −1011 | −796 | 21.3 | 0.35 |
| Sample 2 | −1045 | −831 | 20.5 | 0.41 |
| Sample 3 | −1108 | −903 | 18.5 | 0.45 |
| Sample 4 | −1121 | −897 | 20.0 | 0.72 |
| Sample 5 | −995 | −785 | 21.1 | 0.32 |
| Sample 6 | −1007 | −779 | 22.6 | 0.38 |
| Sample 7 | −1110 | −899 | 19.0 | 0.49 |
| Sample 8 | −986 | −764 | 22.5 | 0.41 |
| Sample 9 | −1018 | −797 | 21.7 | 0.35 |
| Sample 10 | −1003 | −785 | 21.7 | 0.35 |
| Sample 11 | −1058 | −836 | 21.0 | 0.37 |
| Sample 12 | −1115 | −884 | 20.7 | 0.44 |

TABLE 1-continued

| Sample No. | Va (V) | Vi (V) | D (%) | El/2 (lux · sec) |
|---|---|---|---|---|
| Sample 13 | −1019 | −790 | 22.5 | 0.37 |
| Sample 14 | −1049 | −831 | 20.8 | 0.43 |
| Comp. sample (1) | −1033 | −714 | 30.9 | 1.04 |
| Comp. sample (2) | −1163 | −951 | 18.2 | 1.35 |
| Comp. sample (3) | −896 | −679 | 24.2 | 0.30 |
| Comp. sample (4) | −879 | −642 | 27.0 | 0.34 |
| Comp. sample (5) | −794 | −557 | 29.8 | 0.71 |
| Comp. sample (6) | −427 | −256 | 40.0 | 0.55 |
| Comp. sample (7) | −924 | −703 | 23.9 | 0.79 |
| Comp. sample (8) | −897 | −582 | 35.1 | 0.62 |
| Comp. sample (9) | −915 | −709 | 22.5 | 0.67 |

As apparent from these results, the titanylphthalocyanine-vanadylphthalocyanine mixed crystals having the crystal form of the invention has a high sensitivity and a good electrification property without a large sacrifice of sensitivity, when compared with the type-Y titanylphthalocyanine so far known to have a high-sensitivity.

Electrophotographic photoreceptors containing a titanylphthalocyanine-vanadylphthalocyanine mixed crystals having the crystal form according to the invention have a high sensitivity, as well as a good electrification property and charge retention property, and thereby they can be a useful image-forming photoreceptor in printers and copying machines.

What is claimed is:

1. An electrophotographic photoreceptor having a conductive support and a photoreceptive layer comprising a charge generation material and a charge transfer material, wherein the charge generation material is comprised of a mixed crystal containing a titanylphthalocyanine and a vanadylphthalocyanine, said mixed crystal having characteristic peaks at a Bragg angle ($2\theta$) of $27.2\pm0.2°$ and $9.5\pm0.2°$, and in an X-ray diffraction spectrum with a Cu-K$\alpha$ ray (wave length: 1.541 Å) and showing an exothermic peak between 150 and 400° C. in a differential thermal analysis.

2. An electrophotographic photoreceptor according to claim 1, wherein a ratio in weight of the titanylphthalocyanine to a total weight of the titanylphthalocyanine and the vanadyl phtalocyanine is not less than 50%.

3. An electrophotographic photoreceptor according to claim 1, wherein a ratio in weight of the titanylphthalocyanine to a total weight of the titanylphthalocyanine and the vanadyl phtalocyanine is not less than 80%.

4. An electrophotographic photoreceptor according to claim 1, wherein a ratio in weight of the titanylphthalocyanine to a total weight of the titanylphthalocyanine and the vanadyl phtalocyanine is not less than 90%.

5. An electrophotographic photoreceptor according to claim 1, wherein the photoreceptive layer is composed of a charge generation substratum and a charge transfer substratum.

6. An electrophotographic photoreceptor according to claim 1, wherein the peak at a Bragg angle ($2\theta$) of $27.2\pm0.2°$ is a maximum peak.

7. An electrophotographic photoreceptor according to claim 1, wherein said mixed crystal further has an infra-red absorption in the range of 950 to 1050 $cm^{-1}$.

8. An electrophotographic photoreceptor having a conductive support and a photoreceptive layer comprising a charge generation material and a charge transfer material, wherein the charge generation material is comprised of a mixed crystal containing a titanylphthalocyanine and a vanadylphthalocyanine, said mixed crystal having characteristic peaks at a Bragg angle ($2\theta$) of $27.2\pm0.2°$ and $9.1\pm0.2°$, and in an X-ray diffraction spectrum with a Cu-K$\alpha$ ray (wavelength: 1.541 Å) and showing an exothermic peak between 150 and 400° C. in a differential thermal analysis.

9. An electrophotographic photoreceptor according to claim 8, wherein the peak at a Bragg angle ($2\theta$) of $27.2\pm0.2°$ is a maximum peak.

10. An electrophotographic photoreceptor according to claim 8, wherein said mixed crystal further has an infra-red absorption in the range of 950 to 1050 $cm^{-1}$.

* * * * *

UNITED STATES PATENT AND TRADEMARK OFFICE

CERTIFICATE OF CORRECTION

PATENT NO. : 5,354,635

DATED : October 11, 1994

INVENTOR(S) : Akihiko ITAMI et al.

It is certified that error appears in the above-indentified patent and that said Letters Patent is hereby corrected as shown below:

Abstract, title page, line 3 change "genaration" to --generation--.

Abstract, title page, line 5 change "vanadyl phtalocyanine" to --vanadylphthalocyanine--.

Claim 2, column 24, line 53 change "vanadyl phtalocyanine" to --vanadylphthalocyanine--.

Claim 3 column 24, line 58 change "vanadyl phtalocyanine" to --vanadylphthalocyanine--.

UNITED STATES PATENT AND TRADEMARK OFFICE

CERTIFICATE OF CORRECTION

PATENT NO. : 5,354,635

DATED : October 11, 1994

INVENTOR(S) : Akihiko Itami, et al

It is certified that error appears in the above-indentified patent and that said Letters Patent is hereby corrected as shown below:

Claim 4, column 24, line 63 change "vanadyl phtalocyanine" to --vanadylphthalocyanine--.

Signed and Sealed this

Sixteenth Day of May, 1995

*Attest:*

Bruce Lehman

BRUCE LEHMAN

*Attesting Officer*

*Commissioner of Patents and Trademarks*